US010354493B2

(12) United States Patent
Kudo

(10) Patent No.: US 10,354,493 B2
(45) Date of Patent: Jul. 16, 2019

(54) GAMING MACHINE AND METHODS OF PROVIDING GAMES TO PLAYERS WITH TRIGGER SYMBOL REPLACEMENT

(71) Applicant: Konami Gaming, Inc., Las Vegas, NV (US)

(72) Inventor: Hiraku Kudo, Zama (JP)

(73) Assignee: KONAMI GAMING, INC., Las Vegas, NV (US)

( * ) Notice: Subject to any disclaimer, the term of this patent is extended or adjusted under 35 U.S.C. 154(b) by 0 days.

(21) Appl. No.: 15/180,710

(22) Filed: Jun. 13, 2016

(65) Prior Publication Data

US 2017/0092041 A1 Mar. 30, 2017

(30) Foreign Application Priority Data

Sep. 28, 2015 (AU) ..... 2015230848

(51) Int. Cl.
*G07F 17/32* (2006.01)
*G07F 17/34* (2006.01)

(52) U.S. Cl.
CPC ..... *G07F 17/3267* (2013.01); *G07F 17/3213* (2013.01); *G07F 17/3225* (2013.01); *G07F 17/34* (2013.01)

(58) Field of Classification Search
None
See application file for complete search history.

(56) References Cited

U.S. PATENT DOCUMENTS

2005/0070354 A1* 3/2005 Baerlocher ..... G07F 17/3244 463/20
2007/0060261 A1* 3/2007 Gomez ..... G07F 17/3244 463/16
2009/0075721 A1* 3/2009 Pacey ..... G07F 17/3211 463/20
2010/0016061 A1* 1/2010 Gomez ..... G07F 17/3267 463/20
2014/0221075 A1* 8/2014 Lee ..... G07F 17/34 463/20
2015/0325083 A1* 11/2015 Kitamura ..... G07F 17/34 463/20

OTHER PUBLICATIONS

Australian Patent Examination Report No. 1 for Patent Application No. 2015230848 dated Oct. 29, 2015.
Australian Patent Examination Report No. 2 for Patent Application No. 2015230848 dated Feb. 3, 2016.

* cited by examiner

*Primary Examiner* — Jason T Yen
(74) *Attorney, Agent, or Firm* — Howard & Howard Attorneys PLLC

(57) ABSTRACT

A gaming machine for providing a game to a player is described herein. The gaming machine displays a primary game on the display device including a plurality of reels being displayed in a grid that includes cells arranged in rows and columns. The gaming machine generates an outcome of the primary game and detects a triggering condition appearing in the outcome of the primary game including the appearance of a plurality of trigger symbols. The gaming controller initiates a bonus feature game in response to detecting the triggering condition including generating an outcome of bonus feature game including replacing the trigger symbols with a special symbol being displayed within a special symbol area that includes each cell associated with the trigger symbols.

19 Claims, 18 Drawing Sheets

148

| Special Symbol Area Cell Arrangement | Special Symbol |
|---|---|
| 3x2 | Special Symbol A |
| 3x3 | Special Symbol B |
| 3x4 | Special Symbol C |
| 3x5 | Special Symbol D |

Figure 15

150

| Special Symbol | Award Multiplier | Special Symbol Area Cell Arrangement | | | |
|---|---|---|---|---|---|
| | | 3x2 | 3x3 | 3x4 | 3x5 |
| Pic A | 2x | 85% | 75% | 50% | 20% |
| Pic B | 5x | 10% | 20% | 25% | 40% |
| Pic C | 10x | 4% | 4% | 10% | 30% |
| Pic D | 20x | 1% | 1% | 5% | 10% |

Figure 16

GAMING MACHINE AND METHODS OF PROVIDING GAMES TO PLAYERS WITH TRIGGER SYMBOL REPLACEMENT

CROSS-REFERENCE TO RELATED APPLICATION

This application claims priority to Australian Patent Application No. 2015230848, filed Sep. 28, 2015, the disclosure of which is hereby incorporated by reference in its entirety.

COPYRIGHT NOTICE

The figures included herein contain material that is subject to copyright protection. The copyright owner has no objection to the facsimile reproduction by anyone of this patent document as it appears in the U.S. Patent and Trademark Office, patent file or records, but reserves all copyrights whatsoever in the subject matter presented herein.

TECHNICAL FIELD

The subject matter disclosed herein relates generally to gaming machines and more particularly, to gaming machines and method for providing a game to a player that includes a feature game that replaces multiple trigger symbols with a single bonus symbol.

BACKGROUND OF THE INVENTION

Known gaming devices include a video display device to display a reel game that includes a plurality of reels with each reel including a plurality of symbols. During game play, the gaming device accepts a wager from a player, the player selects one or more paylines, the gaming device spins the reels, and sequentially stops each reel to display a combination of symbols on the reels. The gaming device then awards the player an award based on the combination of symbols orientated along the selected payline.

At least some known modern gaming machines frequently have feature game including bonus game, free game and/or progressive game in addition to a primary game or a base game. These gaming machines allow players to play the feature game if triggering condition is satisfied during primary game. The triggering conditions are classifiable into mystery trigger, symbol trigger, system trigger and their combination. The mystery trigger determines the satisfaction of the condition based on random number derived from RNG in the background of the primary game. The symbol trigger determines the satisfaction of the condition based on symbols included in the result of the primary game. And the system trigger determines the satisfaction of the condition based on command/signal from server system such as casino management system, player tracking system, gaming server for providing server-side gaming and the like.

To the manufacturers developing gaming machines, providing an attractive game that can actively draw in casino guests as players is a critical theme to improving functionality of gaming machines. Thus, new feature triggering system is necessary to appeal to player interest and enhance excitement in order to entice longer play and increased profitability. The present invention is directed to satisfying these needs.

SUMMARY OF THE INVENTION

In one aspect of the present invention, a gaming machine for providing a game to a player is provided. The gaming machine includes a display device and a gaming controller coupled to the display device. The gaming controller is configured to display a primary game on the display device including a plurality of reels being displayed in a grid. The grid includes a plurality of cells being arranged in rows and columns, with each reel being displayed within one of the columns and including a plurality of symbols. The gaming controller randomly generates an outcome of the primary game and spin and stop the reels to display the outcome of the primary game. The gaming controller also detects a triggering condition appearing in the outcome of the primary game including the appearance of a plurality of trigger symbols, with each of the trigger symbols being displayed in a corresponding column. The gaming controller initiates a bonus feature game in response to detecting the triggering condition including generating an outcome of bonus feature game including replacing the trigger symbols with a special symbol being displayed within a special symbol area, and providing an award to the player as a function of the outcome of the bonus feature game. The special symbol area includes each cell associated with the trigger symbols.

In another aspect of the present invention, a computer-implemented method of providing a game to a player via a gaming machine is provided. The gaming machine includes a display device and a gaming controller. The computer-implemented method includes displaying a primary game on the display device including a plurality of reels being displayed in a grid that includes a plurality of cells being arranged in rows and columns. The method includes randomly generating an outcome of the primary game and spin and stop the reels to display the outcome of the primary game and detecting a triggering condition appearing in the outcome of the primary game including the appearance of a plurality of trigger symbols. Each trigger symbol is displayed in a corresponding column. The method also includes initiating a bonus feature game in response to detecting the triggering condition including generating an outcome of bonus feature game including replacing the trigger symbols with a special symbol being displayed within a special symbol area, and providing an award to the player as a function of the outcome of the bonus feature game. The special symbol area includes each cell associated with the trigger symbols.

In yet another aspect of the present invention, one or more non-transitory computer-readable storage media, having computer-executable instructions embodied thereon, is provided. The computer-executable instructions cause a processor to display a primary game on a display device including a plurality of reels being displayed in a grid that includes a plurality of cells being arranged in rows and columns. The processor randomly generates an outcome of the primary game and spin and stop the reels to display the outcome of the primary game, and detects a triggering condition appearing in the outcome of the primary game including the appearance of a plurality of trigger symbols. The processor initiates a bonus feature game in response to detecting the triggering condition including generating an outcome of bonus feature game including replacing the trigger symbols with a special symbol being displayed within a special symbol area, and providing an award to the player as a function of the outcome of the bonus feature game. The special symbol area includes each cell associated with the trigger symbols.

BRIEF DESCRIPTION OF THE DRAWINGS

Other advantages of the present invention will be readily appreciated as the same becomes better understood by reference to the following detailed description when considered in connection with the accompanying drawings wherein:

FIGS. 15 and 16 are exemplary illustrations of data records that may be used by the gaming device shown in FIG. 1, according to an embodiment of the present invention.

Corresponding reference characters indicate corresponding parts throughout the drawings.

DETAILED DESCRIPTION OF THE PREFERRED EMBODIMENT

With reference to the drawings and in operation, the present invention overcomes a problems rooted in gaming machine technology and at least some of the disadvantages of known gaming systems by providing a gaming machine that detects the appearance of trigger symbols in a game outcome and initiates a bonus feature game including replacing the trigger symbols and game symbols being displayed between the trigger symbols with a high value special symbol. By replacing the trigger symbols and the other game symbols with a high value special symbol, the gaming machine increases the probability of obtaining a winning outcome during the bonus feature game.

Hence, player can enjoy a higher expectation of obtaining an award during the bonus feature game. This makes the game rules simple and easy to understand for the player, and reduces the need for complex game play, thus reducing computing resources.

In addition, the present invention improves the functionality of known gaming machines by increasing the probability of providing bonus features to a player without requiring additional special symbols and/or feature triggers, and increases a probability of providing a higher value award without requiring different game paytables. Thus, the computer resources required to display bonus features is significantly reduced over known gaming machines.

A selected embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

Figure 1:
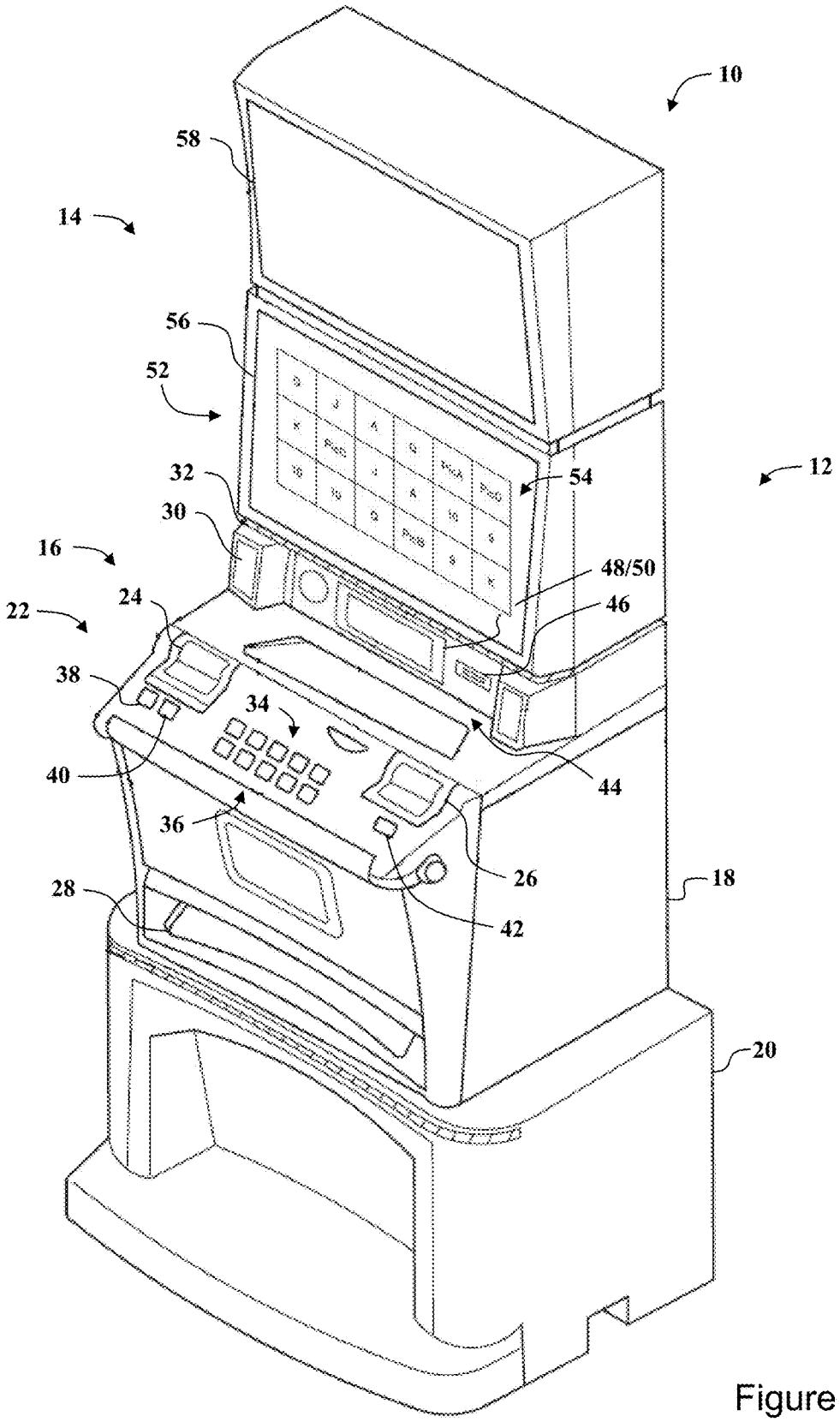
FIG. 1 is a perspective view of an exemplary gaming device for use in providing a game to a player, according to an embodiment of the present invention.
Figure 2:
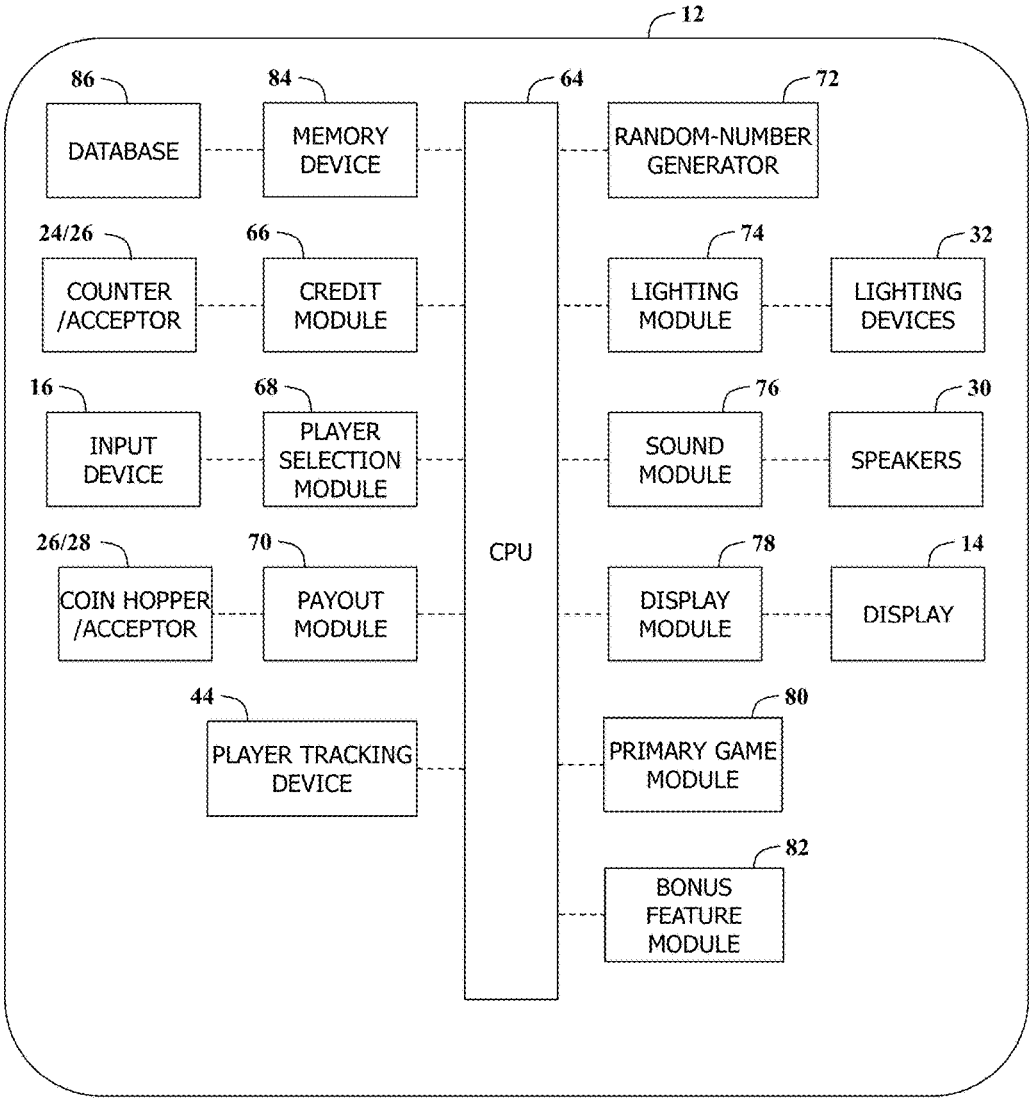
FIG. 2 is a schematic representation of a gaming controller that may be used with the gaming device shown in FIG. 1, according to an embodiment of the present invention.

FIG. 1 is a perspective view of an exemplary gaming device 10 for providing an award to a player, according to an embodiment of the present invention. FIG. 2 is a schematic representation of a gaming controller 12 that may be used with the gaming device 10. In the illustrated embodiment, the gaming device 10 includes a display device 14 for displaying a plurality of games, a user input device 16 to enable a player to interface with the gaming device 10, and a gaming controller 12 that is operatively coupled to the display device 14 and the user input device 16 to enable a player to play games being displayed on the display device 14. In one embodiment, the gaming device 10 may include a gaming machine installed in a casino. In another embodiment, the gaming device 10 may include a personal computer, laptop, cell phone, smartphone, tablet computer, personal data assistant, and/or any suitable computing device.

In the illustrated embodiment, the gaming device 10 also includes a cabinet assembly 18 that is configured to support the display device 14, the user input device 16, and/or the gaming controller 12 from a gaming stand 20 and/or a supporting surface. The display device 14 and the user input device 16 are each coupled to the cabinet assembly 18 and are each accessible by the player. In one embodiment, the gaming controller 12 is positioned within the cabinet assembly 18. Alternatively, the gaming controller 12 may be separated from the cabinet assembly 18, and connected to components of the gaming device 10 through a network such as, for example, a LAN, a WAN, dial-in-connections, cable modems, wireless modems, and/or special high-speed ISDN lines. For example, in one embodiment, the gaming controller 12 may be located remotely with respect to the gaming device 10, or within another gaming device 10.

The user input device 16 includes a plurality of input buttons 22, a coin slot 24, and/or a bill acceptor 26. The coin slot 24 includes an opening that is configured to receive coins and/or tokens deposited by the player into the gaming device 10. The gaming controller 12 converts a value of the coins and/or tokens to a corresponding amount of gaming credits that are used by the player to wager on games played on the gaming device 10. In one embodiment, the user input device 16 may include an acceptor device which accepts media associated with a monetary value to establish a credit balance, a validator device configured to identify physical media, and a cash-out button actuatable to cause an initiation of a payout associated with the credit balance. In one embodiment, the acceptor device may be configured to receive physical media such as, for example, a coin, a medal, a ticket, a card, a bill, currency, and/or any suitable physical media that enables the gaming device 10 to function as described herein. The acceptor device may also be configured to accept virtual media such as, for example, an RFID signal, a keypad and/or touch screen entry, a personal identification number and/or identifier, a player tracking account, a virtual credit balance, reward points, gaming credits, bonus points, and/or any suitable virtual media that enables the gaming device 10 to function as described herein. For example, in one embodiment, the coin slot may include an opening that is configured to receive coins and/or tokens deposited by the player into the gaming device 10.

The bill acceptor 26 includes an input and output device that is configured to accept a bill, a ticket, and/or a cash card into the bill acceptor 26 to enable an amount of gaming credits associated with a monetary value of the bills, ticket, and/or cash card to be credited to the gaming device 10. Moreover, the gaming device 10 may also utilize a cashless wagering system (not shown), such as a ticket in ticket out (TITO) system (not shown). In one embodiment, the bill acceptor 26 also includes a printer (not shown) that is configured to dispense a printed voucher ticket that includes information indicative of an amount of credits and/or money paid out to the player by the gaming device 10 during a gaming session. The voucher ticket may be used at other gaming devices, or redeemed for cash, and/or other items as part of a casino cashless system (not shown). In one embodiment, the acceptor device and/or the validator device may include the coin slot 24, the bill acceptor 26, a TITO system, a cashless wagering system, and/or a player tracking device.

A coin hopper 28 is coupled to the cabinet assembly 18 and is configured to receive a plurality of coins that are dispensed from the gaming device 10. One or more speakers 30 are installed inside the cabinet assembly 18 to generate voice announcements and/or sound effects associated with game play. The gaming device 10 also includes one or more lighting devices 32 that are configured to blink and/or change brightness and color in specific patterns to produce lighting effects to enhance a visual gaming experience for the player.

In one embodiment, the input buttons 22 include a plurality of BET switches 34 for inputting a wager on a game, a plurality of selection switches 36 for selecting a betting line, a payline, and/or card, a MAXBET switch 38 for inputting a maximum wager, a PAYOUT switch 40 for ending a gaming session and dispensing accumulated gaming credits to the player, and a start switch, i.e., a SPIN/DEAL button 42 to initiate an output of a game. In the illustrated embodiment, the user input device 16 may include a plurality of physical buttons coupled to the cabinet assembly 18. In another embodiment, the user input device 16 may include a video touch display that displays video images of the input buttons 22. The user input device 16 may also include a touchless display being displayed with changeable video images of the input buttons 22.

In the illustrated embodiment, the BET switches 34 include five switches from 1BET to 5BET to enable a player to wager between a minimum bet up to 5× minimum bet. Each selection switch 36 corresponds to a betting line such as, for example, a payline and/or symbol for a reel game, one or more cards for a card game, and/or a symbol for a roulette game, to enable a player to associate a wager with one or more betting lines. The MAXBET switch 38 enables a player to input the maximum bet that a player can spend against one play of a game. The PAYOUT switch 40 enables a player to receive the amount of money and/or credits awarded to the player during a gaming session, which has been credited onto the gaming device 10.

The gaming device 10 also includes a player tracking device 44 that is coupled to the gaming controller 12 for identifying the player and/or a player tracking account that is associated with the player. The player tracking account may include, but is not limited to, gaming credits available to the player for use in playing the gaming device 10. The player tracking device 44 is configured to communicate player account information between a player tracking controller (not shown) and the gaming device 10. For example, the player tracking device 44 may be used to track bonus points and/or credits awarded to the player during a gaming session and/or track bonus and/or credits downloaded to the gaming device 10 from the player tracking system. In the illustrated embodiment, the player tracking controller assigns a player status, e.g., a player ranking, based on the player account information. For example, the player tracking information may include, but is not limited to, a frequency in which the player plays a game, the average wager the player makes per play of a game, a total amount wagered by the player over a predefined period of time, and/or any other suitable player tracking information.

The player tracking device 44 is coupled to the gaming cabinet assembly 18 and includes a player identification card reader 46, a data display 48, and a keypad 50. The player identification card reader 46 is configured to accept a player tracking card (not shown) inserted by the player, and read information contained on the player tracking card to identify the player account information. The player identification card reader 46 may include, but is not limited to, a barcode reader, a magnetic card reader, and/or a radio frequency identification (RFID) card reader. The keypad 50 is configured to accept a user selection input such as, for example, a unique player personal identification number (PIN) to facilitate enabling the gaming device 10 to identify the player, and access player account information associated with the identified player to be displayed on the data display 48. In one embodiment, the data display 48 includes a touchscreen panel that includes the keypad 50. Alternatively, the data display 48 and the keypad 50 may be included in the display device 14.

In the illustrated embodiment, the display device 14 is configured to display a game 52 on a game screen including indicia and/or symbols for use in the game 52, e.g., cards used by a card game, roulette wheel and symbols used in a roulette game, reels used in a reel game and/or symbols and images used in a wheel-type game. The game 52 may include any type of game including, but not limited to, a video slot game, a keno game, a blackjack game, a video poker game, a wheel-type game, a roulette-type game, and/or any type of game which allows a player to make a wager, play a game, and potentially provide the player an award based on an outcome of the game and a paytable. In one embodiment, the display device 14 may include a first display 56 and a second display 58. Moreover, each display 56 and 58 may be configured to display at least a portion of the game screen 54.

In one embodiment, the first display 56, and/or the second display 58 may include a flat panel display, such as a cathode ray tube display (CRT), a liquid crystal display (LCD), a light-emitting diode display (LED), an organic light-emitting diode display (OLED), an active-matrix organic light-emitting diode display (AMOLED), a plasma display, and/or any suitable visual output device capable of displaying graphical data and/or text to a user. Alternatively, a single component, such as a touch screen, may function as both the display device 14 and as the user input device 16. In an alternative embodiment, the first display 56 and/or the second display 58 may include a plurality of mechanical reels displaying a plurality of game symbols.

Referring to FIG. 2, in one embodiment, the gaming controller 12 may include a processor, i.e., a central processing unit (CPU) 64, a credit module 66, a player selection module 68, a payout module 70, a random-number generator (RNG) 72, a lighting module 74, a sound module 76, a display module 78, a primary game module 80, a bonus feature module 82, a memory device 84, and a database 86. The memory device 84 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the CPU 64 to store, retrieve, and/or execute instructions and/or data.

The CPU 64 executes various programs, and thereby controls other components of the gaming controller 12 according to player instructions and data accepted by the user input device 16. The CPU 64 in particular executes a game program, and thereby conducts a game in accordance with the embodiments described herein. The memory device 84 stores programs and databases used by the CPU 64. Moreover, the memory device 84 stores and retrieves information in the database 86 including, but not limited to, wagers, wager amounts, average wagers per game, a game type, awards, type of awards, a number of reels associated with a game, a number of symbols being displayed on each reel, trigger symbols, special symbols, free games awards, bonus awards, primary game awards, and/or image data for producing game images and/or screens on the display device 14, and temporarily stores variables, parameters, and the like that are used by the CPU 64. In addition, the memory device 84 stores indicia, symbol weights, symbol values, paytables, selection probabilities, and/or winning combination tables which represent relationships between combinations of random numbers and types of awards. In one embodiment, the memory device 84 utilizes RAM to temporarily store programs and data necessary for the progress of the game, and EPROM to store, in advance, programs and data for controlling basic operation of the gaming device 10, such as the booting operation thereof.

The credit module 66 manages the amount of player's credits, which is equivalent to the amount of coins and bills counted and validated by the bill acceptor 26. The player selection module 68 monitors player selections received through the input buttons 22, and accepts various instructions and data that a player enters through the input buttons 22. The payout module 70 converts a player's credits to coins, bills, or other monetary data by using the coin hopper 28 and/or for use in dispensing a credit voucher via the bill acceptor 26.

The lighting module 74 controls one or more lighting devices 32 to blink and/or change brightness and color in specific patterns in order to produce lighting effects associated with game play. The sound module 76 controls the speakers 30 to output voice announcements and sound effects during game play.

The display module 78 controls the display device 14 to display various images on a graphical interface including the game screen 54 preferably by using computer graphics and image data stored in the memory device 84. More specifically, the display module 78 controls video reels and symbols being displayed with the game 52 and images being displayed in the game screen 54 displayed on the first display 56 and/or the second display 58 by using computer graphics and the image data. In another embodiment, the display device 14 includes a plurality of mechanical reels. The display module 78 is configured to control a rotation of each of the plurality of mechanical reels to spin and stop each reel to display a game outcome.

The RNG 72 generates and outputs random numbers to the CPU 64 preferably at the start of each round of a game. The CPU 64 uses the random numbers to determine an outcome of the games. For example, if the game is a video slot game, the CPU 64 uses the RNG 72 to randomly select an arrangement of symbols to be displayed on video reels. Moreover, the CPU 64 generally uses random numbers generated by the RNG 72 to play the games and to determine whether or not to provide an award to a player. In one embodiment, the CPU 64 may also use the random numbers to determine a stop position of each reel for use in stopping each of a plurality of mechanical reels being displayed in the display device 14 to display the game outcome. The CPU 64 may also receive combinations of random numbers from the RNG 72 and compare the generated combinations with winning combinations stored in the winning combination table to determine if the generated outcome is a winning outcome that is associated with a type of award. In general, the term "award" may be a payout, in terms of credits or money. Thus, the CPU 64 may award a regular payout in response to the outcome of the game 52. However, it should be noted that the term award may also refer to other types of awards, including, prizes, e.g., meals, show tickets, etc . . . , as well as in-game award, such as bonus features, free games, and/or free spins, or awarding the player one or more wild symbols or stacked wild symbols in each of the games. The RNG 72 may be implemented in software, firmware or hardware. An implementation of software RNG 72 may include a random generator program that is executed by CPU 64 or other processing unit.

Figure 6:
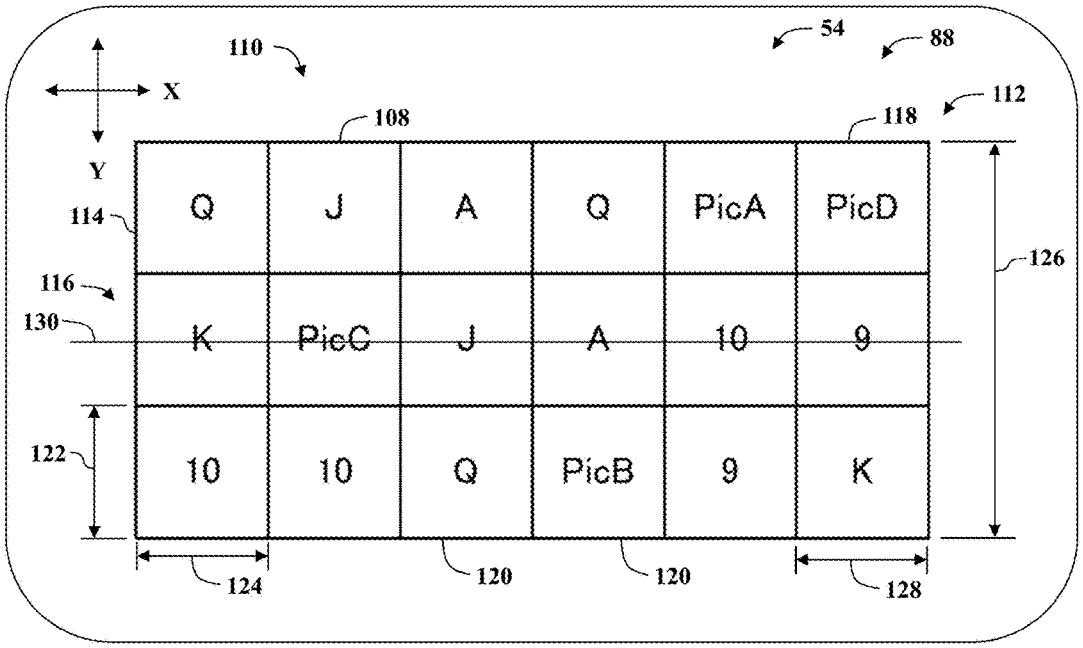
FIG. 6 is an exemplary entertaining graphical display of a game screen including a primary slot-type game that may be displayed on the gaming device shown in FIG. 1, according to an embodiment of the present invention.

The primary game module 80 includes a game program for use in executing a primary game 88 (shown in FIG. 6) being displayed on the display device 14. In the illustrated embodiment, the primary game 88 is a video slot game. However, it should be noted that the primary game 88 may be any type of game upon which a player could make a wager including, but not limited to a keno game, a blackjack game, a video poker game, or any type of game that enables the gaming controller 12 to function as described herein. During play of the primary game 88, the primary game module 80 retrieves image data from the database 86 and displays the primary game 88 including a plurality of reels, each being displayed with the plurality of symbols. The primary game module 80 receives one or more wagers from the player via the user input device 16, responsively generates and outcome of the primary game 88, determines if the game outcome is a winning outcome, and provides an award to the player, if any, as a function of game outcome and the wager. Moreover, the primary game module 80 receives one or more random numbers from the RNG 72, determines an outcome of the primary game 88 as a function of the received random numbers, and spins and stops the reels to display the outcome of the primary game 88 on the display device 14.

The bonus feature module 82 includes a game program for use in executing a bonus feature game 90 (shown in FIGS. 11-14). In the illustrated embodiment, the bonus feature module 82 is configured to detect one or more triggering conditions occurring in the outcome of the primary game 88 and to initiate the bonus feature game 90 upon detecting the triggering conditions.

Figure 7:
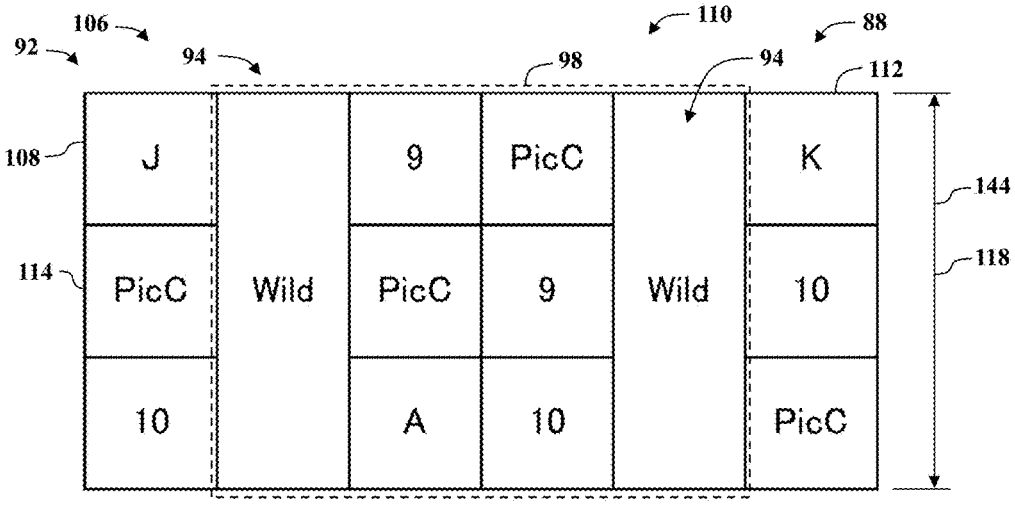
FIG. 7 is another exemplary entertaining graphical display of the game screen including the primary slot-type game shown in FIG. 7, according to an embodiment of the present invention.

Referring to FIG. 7, in the illustrated embodiment, the bonus feature module 82 is programmed to detect a triggering condition 92 appearing in the outcome of the primary game 88 including the appearance of a plurality of trigger symbols 94. The bonus feature module 82 initiates the bonus feature game 90 in response to detecting the triggering condition 92 and replaces the trigger symbols 94 with a special symbol 96 (shown in FIG. 11*e*).

In one embodiment, the triggering condition 92 includes each of the trigger symbols 94 being displayed across a full height of the corresponding columns. The bonus feature module 82 generates an outcome of the bonus feature game 90 including the special symbol 96 and determines whether to provide the player an award as a function of the symbols being displayed in the outcome of the bonus feature game 90 and a corresponding paytable. In one embodiment, the special symbol 96 may be a wild symbol that may be substituted for any other symbol and/or symbols to facilitate increasing the probability of the player receiving a higher value award. The bonus feature module 82 may also be configured to select the special symbol 96 from a set of special symbols as a function of a number of cells included in a special symbol area 98 and/or the size and/or shape of the special symbol area 98.

In the illustrated embodiment, upon detecting the triggering condition 92, the bonus feature module 82 determines a special symbol area 98 associated with the displayed trigger symbols 94, and displays the special symbol 96 within the special symbol area 98. In one embodiment, the special symbol area 98 includes each symbol position and/or cell being displayed with a corresponding trigger symbol 94. In addition, the special symbol area 98 may also include each symbol position and/or symbol cell that is orientated between the trigger symbols 94.

For example, in one embodiment, as shown in FIG. 7, the bonus feature module 82 may detect trigger symbols 94 appearing in corresponding reel symbol columns in the outcome of the primary game 88, and determine the special symbol area 98 to include each symbol column being displayed with a trigger symbol 94 and each symbol column orientated between the trigger symbol columns. The bonus feature module 82 may then generate the outcome of the bonus feature game 90 by replacing each symbol being displayed within the special symbol area 98 with the special symbol 96, and evaluate the outcome of the bonus feature game 90 to determine if an award is to be provided. For example, the outcome of the primary game 88 may include at least one reel being displayed between at least two trigger symbols 94. The bonus feature module 82 may be configured to initiate the bonus feature game 90 including replacing each of the at least two trigger symbols 94 and each symbol being displayed with the adjacent reel with the special symbol 96. In addition, the bonus feature module 82 may display a transition image 100 within the special symbol area 98 before displaying the special symbol 96 to notify the player of the initiated bonus feature game 90.

In one embodiment, the bonus feature module 82 may initiate the bonus feature game 90 including a number of game instances and/or free games. During each instance of the bonus feature game 90, the bonus feature module 82 may retain the special symbol 96 within the special symbol area 98, randomly generate an outcome for the corresponding game instances and spin and stop the remaining reels to display the corresponding game instance. For example, the bonus feature module 82 may display the outcome of the bonus feature game 90 including spinning and stopping the reels with the special symbol 96 being held in position. The bonus feature module 82 may also evaluate each outcome and provide an award to the player as a function of the outcome of each game instance.

Figure 12A:
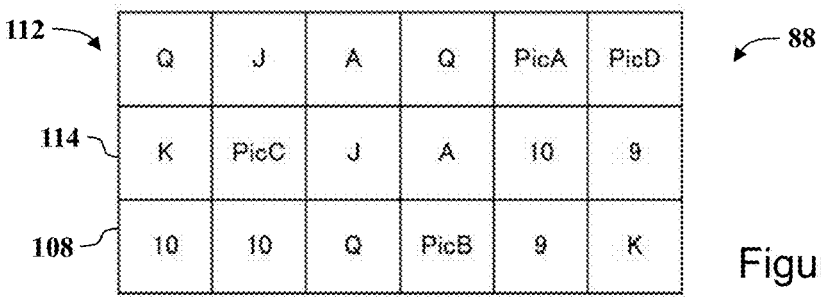
FIGS. 12*a*-12*k* are exemplary entertaining graphical displays of a bonus feature game that may be displayed on the gaming device shown in FIG. 1, according to an embodiment of the present invention.
Figure 12B:
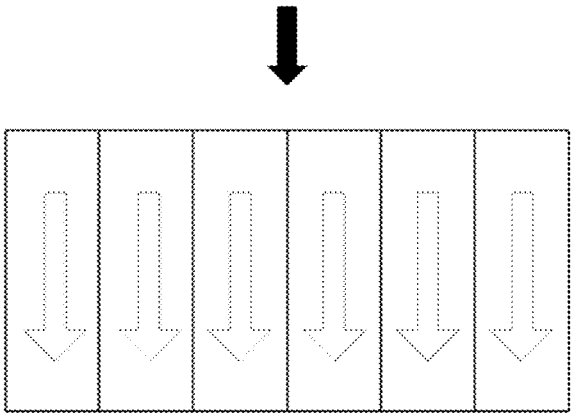
Figure 12C:
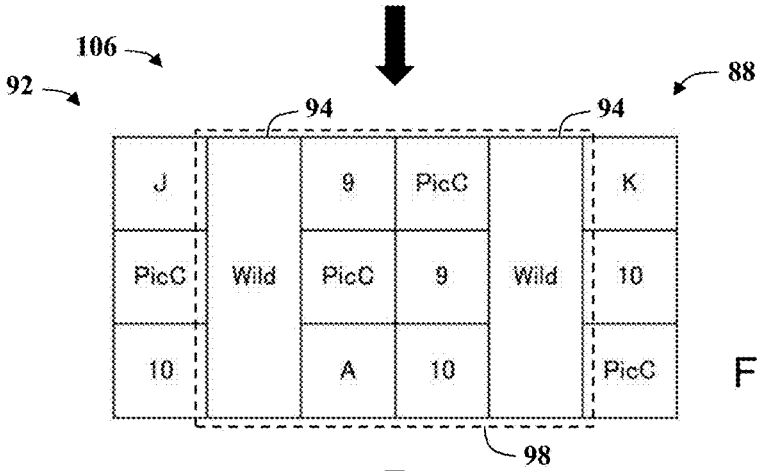
Figure 12D:
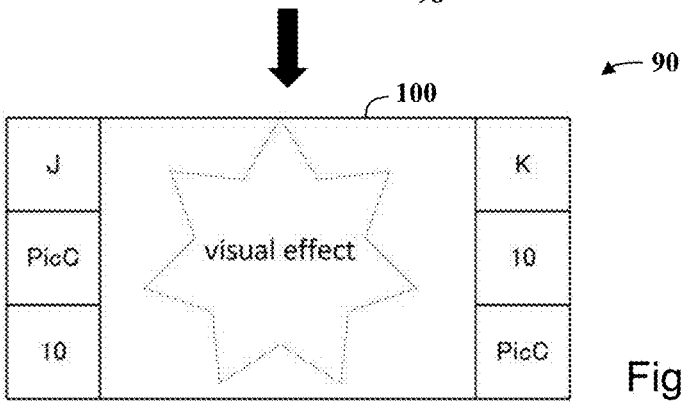
Figure 12E:
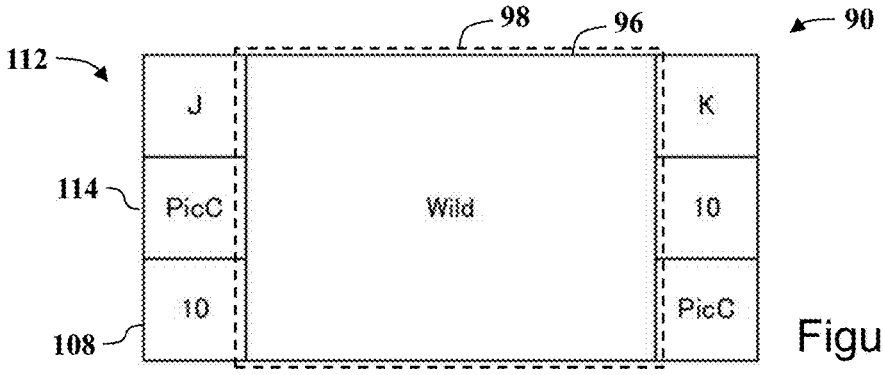
Figure 12F:
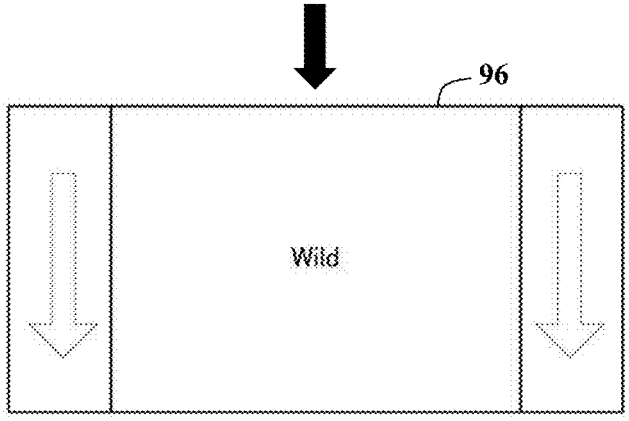
Figure 12G:
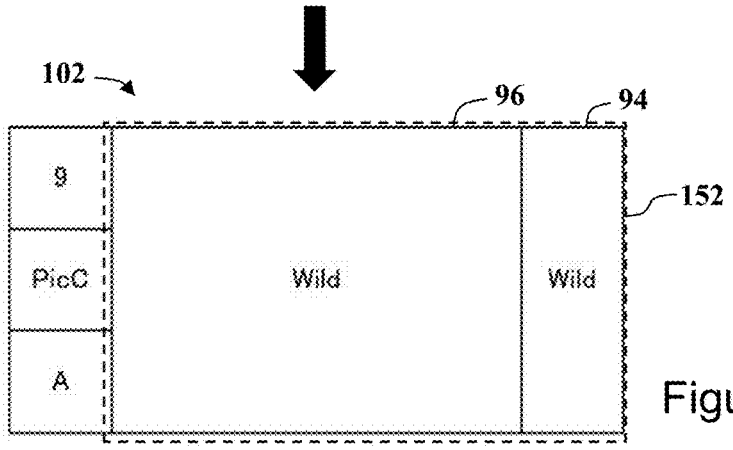
Figure 12H:
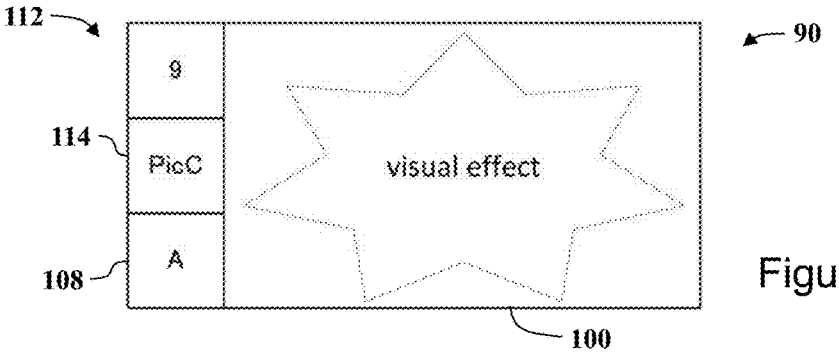
Figure 12I:
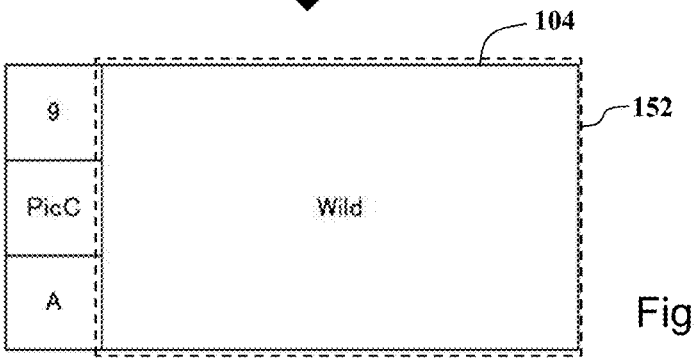
Figure 12J:
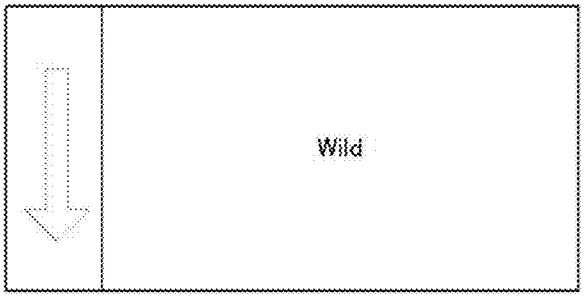
Figure 12K:
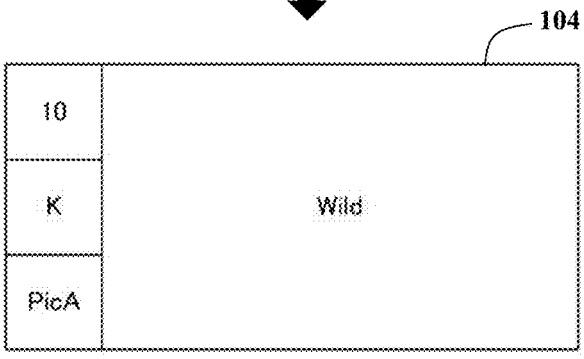
Figure 13A:
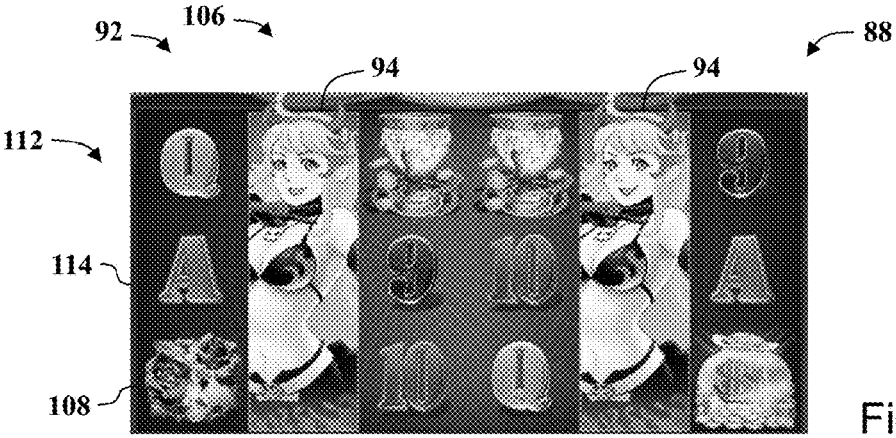
FIGS. 13*a*-13*f* are exemplary entertaining graphical displays of the bonus feature game shown in FIG. 12*a*-12*k*, according to an embodiment of the present invention.
Figure 13B:
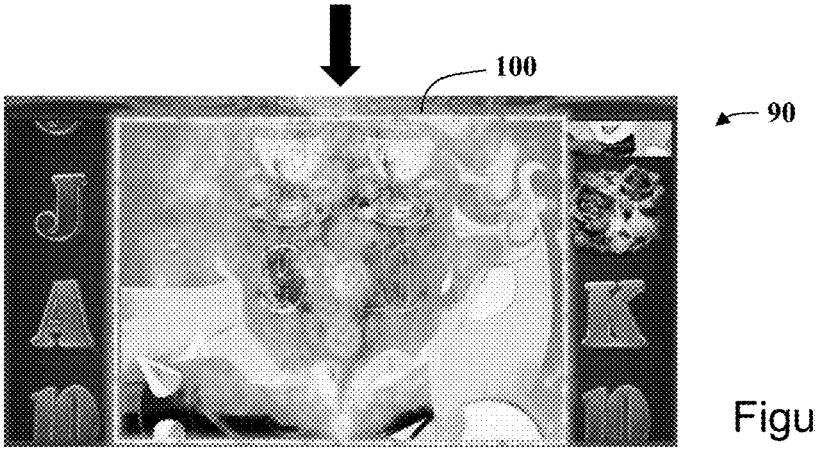
Figure 13C:
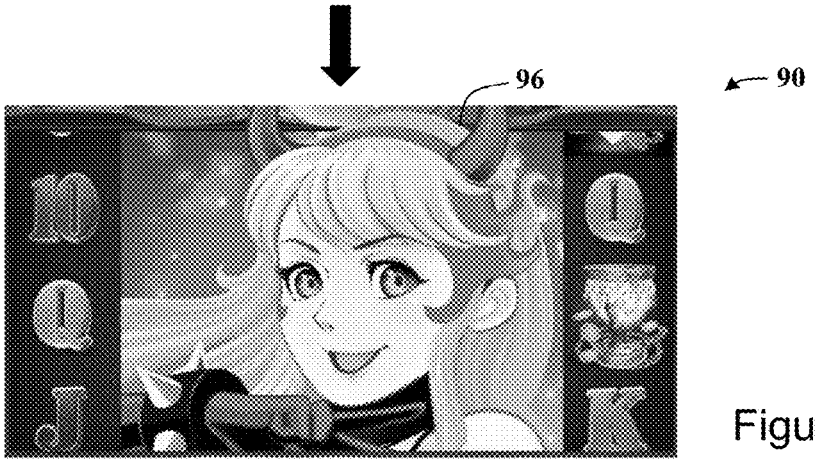
Figure 13D:
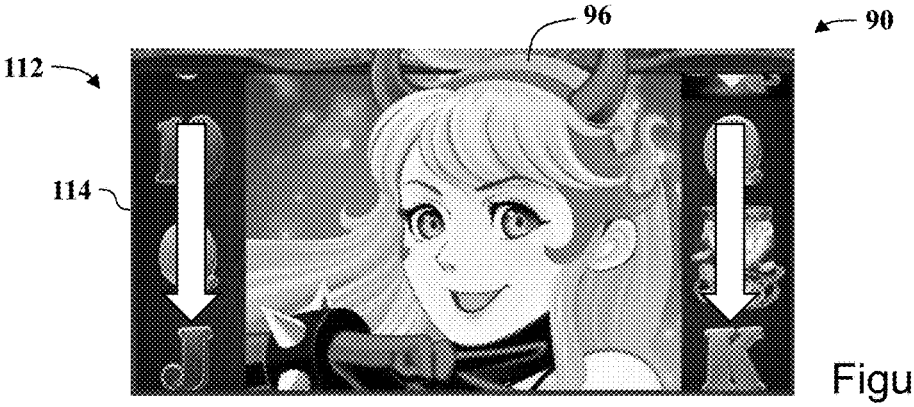
Figure 13E:
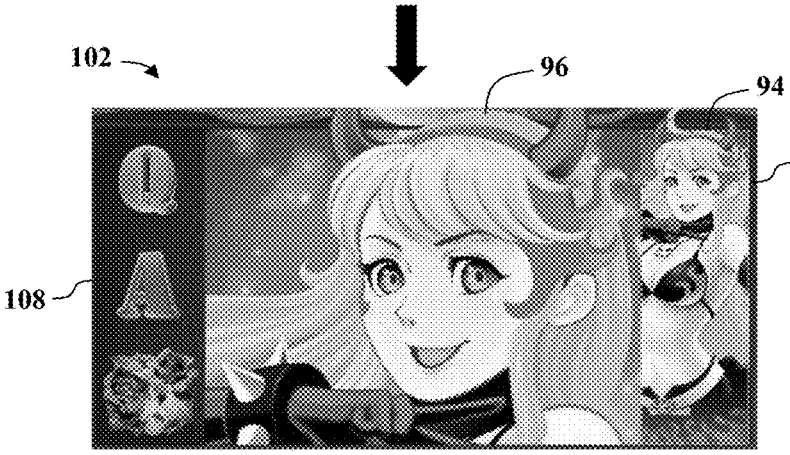
Figure 13F:
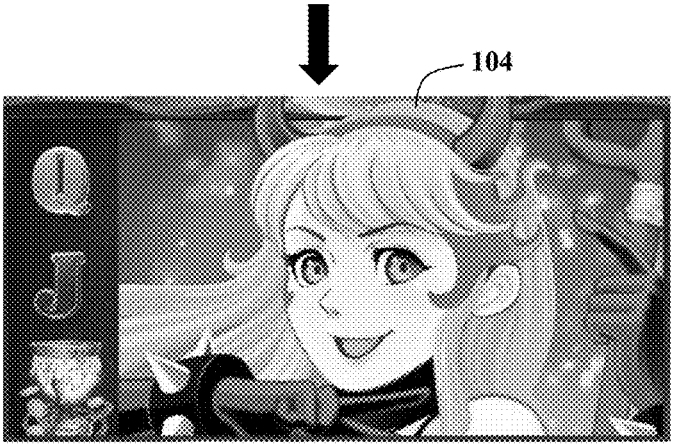
Figure 14A:
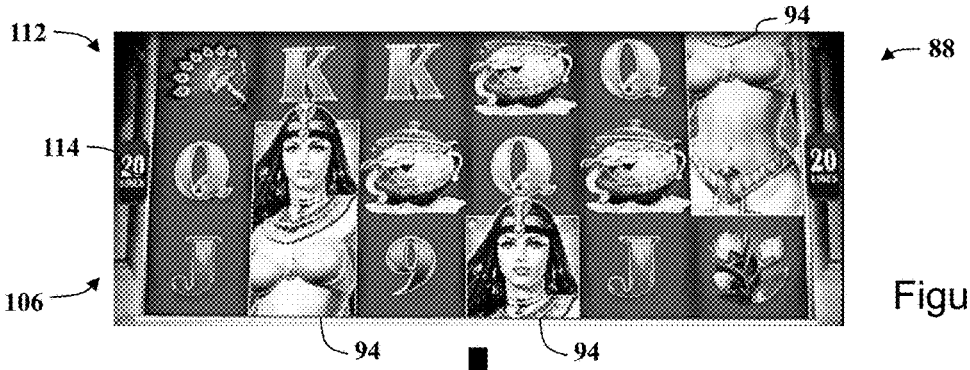
FIGS. 14*a*-14*d* are exemplary entertaining graphical displays of a bonus feature game that may be displayed on the gaming device shown in FIG. 1, according to an embodiment of the present invention.
Figure 14B:
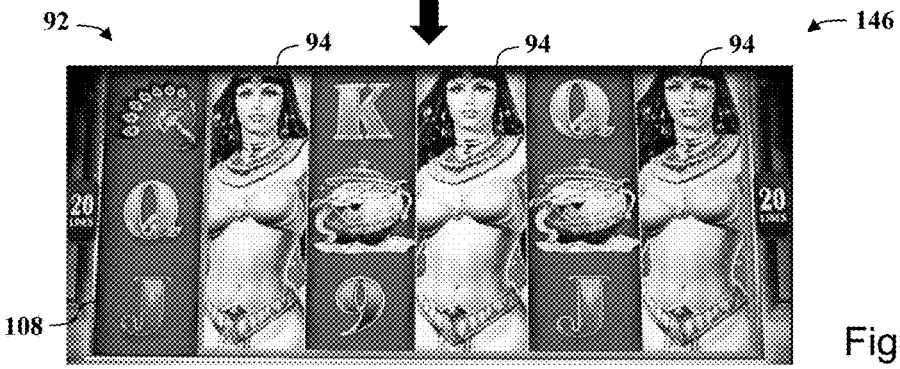
Figure 14C:
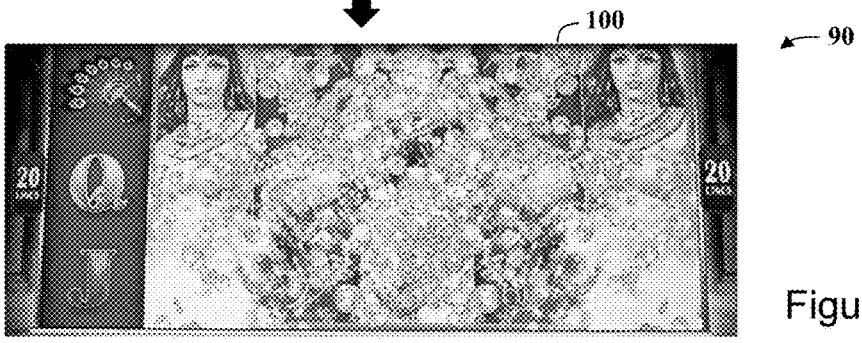
Figure 14D:
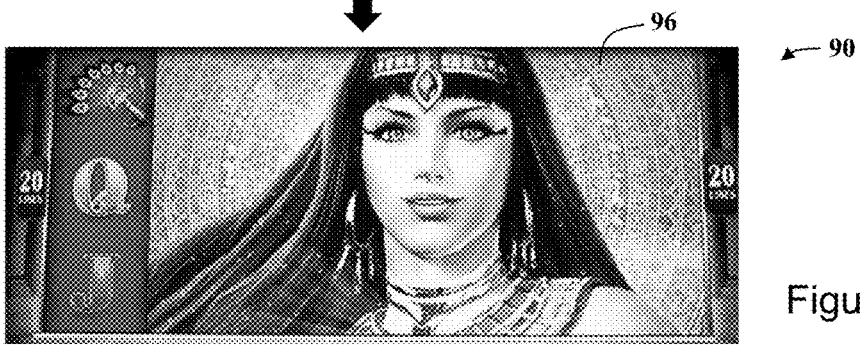

In addition, as shown in FIGS. 12*g* and 13*e*, the bonus feature module 82, during an instance of the bonus feature game 90, the bonus feature module 82 may detect a retriggering condition 102 appearing in the outcome of the bonus feature game 90. In one embodiment, the retriggering condition 102 may including another trigger symbol 94 being displayed in the outcome of the bonus feature game 90. Upon detecting the retriggering condition 102, the bonus feature module 82 replaces the special symbol 96 and the displayed trigger symbol 94 with a second special symbol 104 that extends across the area associated with the special symbol 96 and each symbol cell associated with displayed trigger symbol 94. In addition, in one embodiment, the bonus feature module 82 may detect one or more reels being displayed between the special symbol 96 and the trigger symbol 94, and replace each of the special symbol 96, the trigger symbol 94, and the symbols displayed in the intervening reel with the second special symbol 104. The bonus feature module 82 evaluates the outcome including the second special symbol 104 and responsively provides an award to the player. In addition, the bonus feature module 82 may also initiate a subsequent instance of the bonus feature game 90 with the second special symbol 104 being retained in position.

In one embodiment, as shown in FIGS. 14*a*-14*d*, the bonus feature module 82 may evaluate the outcome of the primary game 88 to determine if at least a portion of a trigger symbol 94 is displayed in the outcome of the primary game. The bonus feature module 82 may responsively modify the outcome of the primary game 88 by moving and/or nudging the corresponding reel to display the corresponding trigger symbol 94 across the full height of the corresponding column. The bonus feature module 82 may then determine if the triggering condition 92 is detected in the modified outcome of the primary game 88, and responsively initiate the bonus feature game 90.

Figure 3:
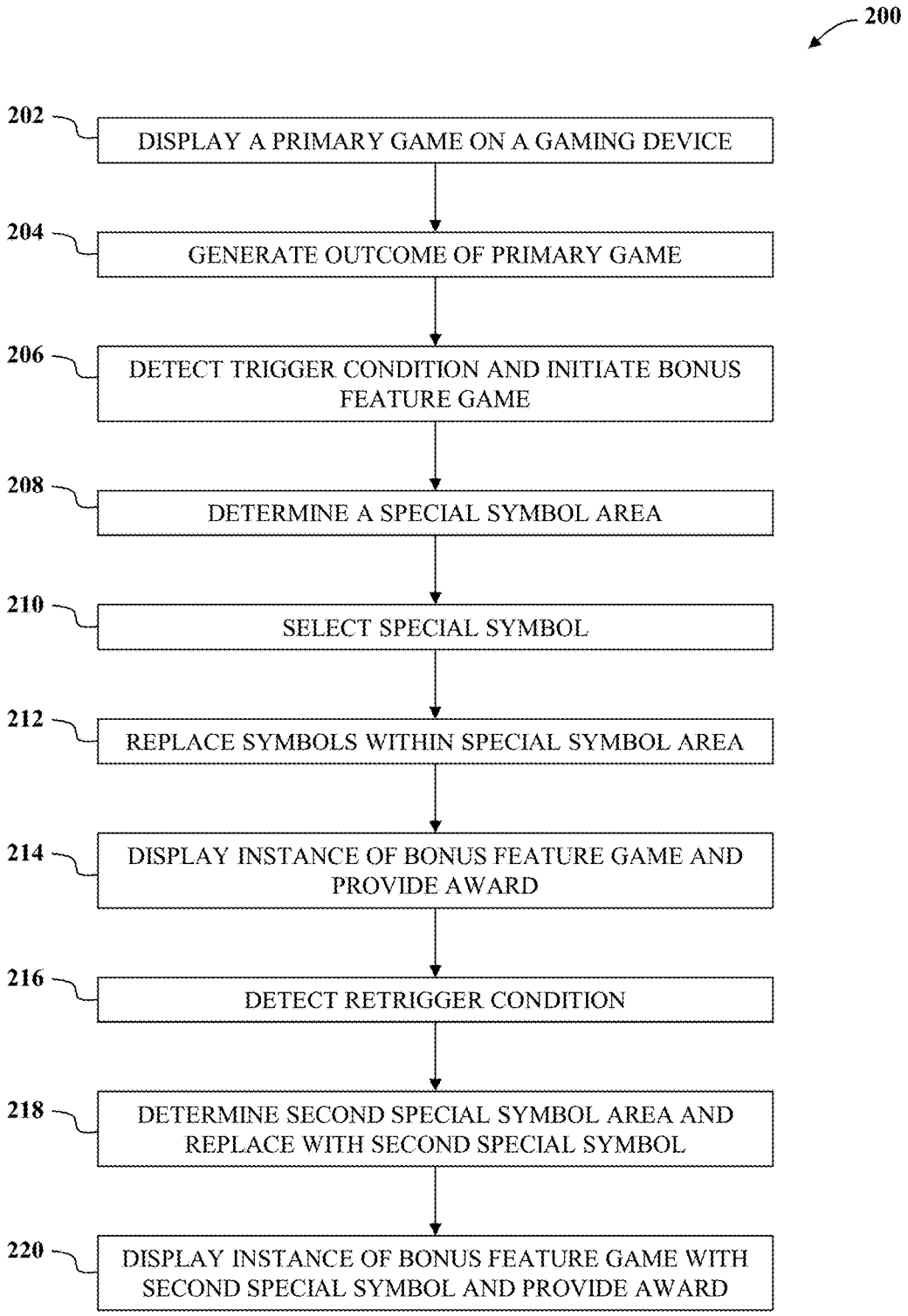
FIG. 3 is a flowchart of a method that may be used with the gaming device shown in FIG. 1 for providing a game to a player, according to an embodiment of the present invention.
Figure 4:
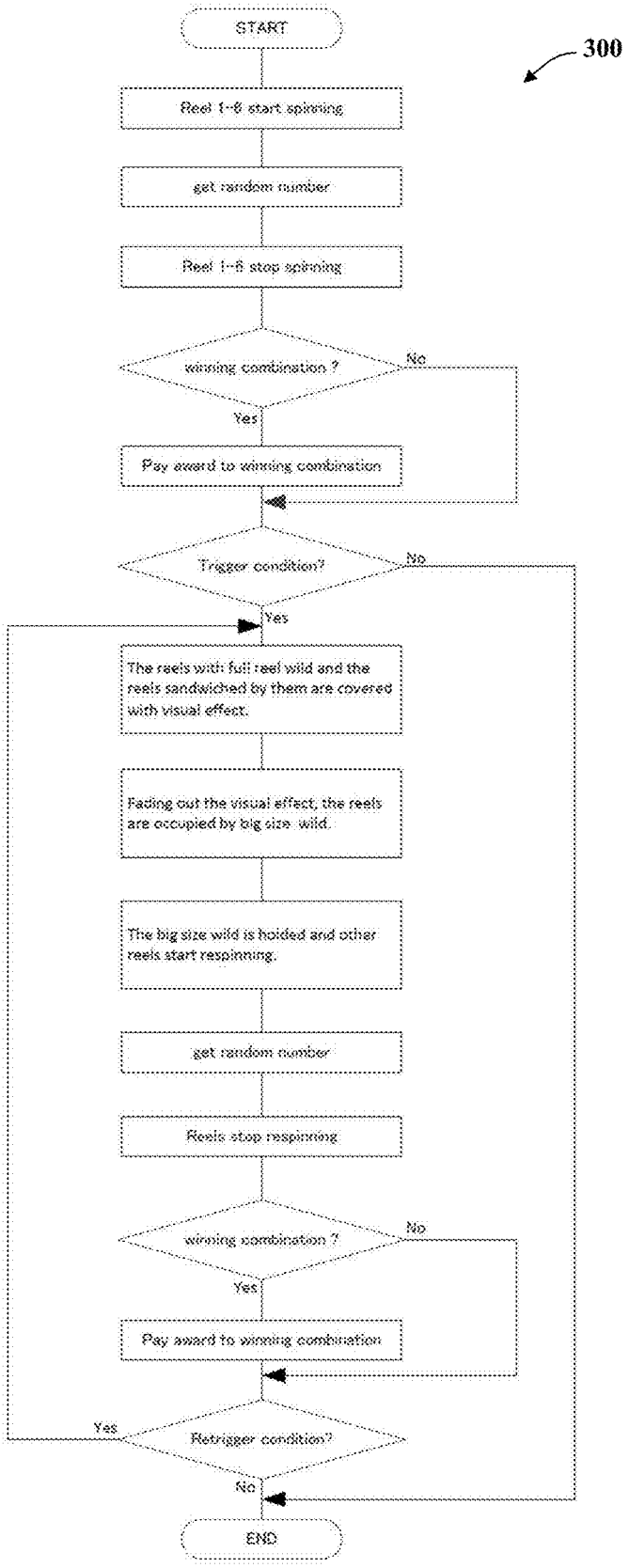
FIGS. 4 and 5 are flowcharts of methods that may be used with the gaming device shown in FIG. 1 for providing a game to a player, according to an embodiment of the present invention.
Figure 5:
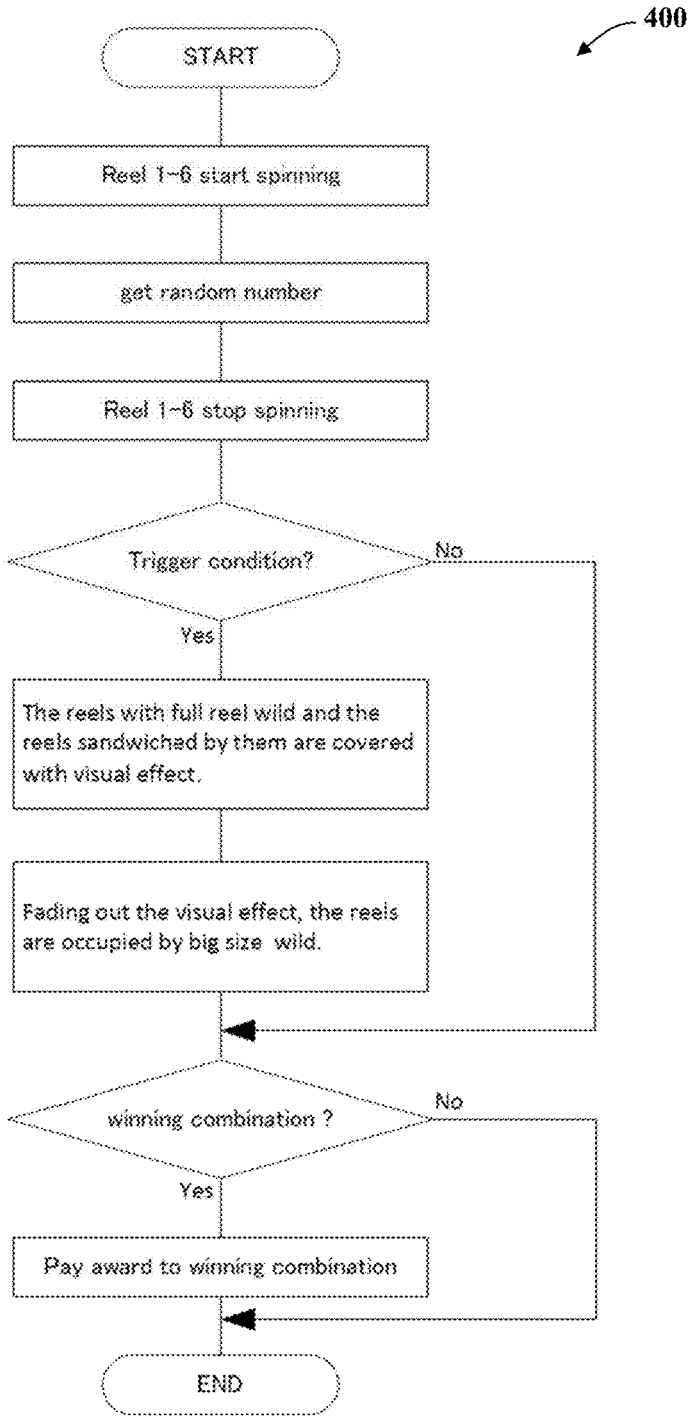

FIG. 3 is a flowchart of a method 200 that may be used with the gaming device 10 to provide a primary game and a secondary game to a player. FIGS. 4 and 5 are flowcharts of additional methods 300 and 400 that may be used by the gaming device 10 to provide the primary game and the bonus feature game 90. The methods 200, 300, and 400 include a plurality of steps. Each method step may be performed independently of, or in combination with, other method steps. Portions of the methods may be performed by any one of, or any combination of, the components of the one or more gaming devices 10. FIGS. 6-14 are exemplary entertaining graphical displays of the primary game 88 and the bonus feature game 90 that may be played with the gaming device 10.

In general, the gaming controller 12 is programmed to randomly generate an outcome of the primary game 88, detect the triggering condition including the trigger symbols 94 appearing in the primary game outcome, and initiate a bonus feature game 90 in response to detecting the triggering condition 92. During the bonus feature game 90, the gaming controller 12 selects a special symbol 96 and replaces the trigger symbols 94 and each game symbol being displayed between the trigger symbols 94 with the special symbol 96. The special symbol 96 may be a wild symbol that may be substituted for any other game symbol. By replacing the trigger symbols and each symbol orientated between the trigger symbols with a wild symbol, the gaming machine increases the probability of obtaining a winning outcome during the bonus feature game 90.

In the illustrated embodiment, in method step 202, the gaming controller 12 receives a signal indicative of a wager being received by the gaming device 10 and responsively displays the primary game 88 on the display device 14. In one embodiment, the primary game 88 is a video slot game. However, it should be noted that the game 52 may be any type of game upon which a player could make a wager including, but not limited to a keno game, a blackjack game, a video poker game, or any type of game that enables the gaming controller 12 to function as described herein. In addition, in one embodiment, the game 52 may include a slot game being displayed with a plurality of mechanical reels (not shown). In the illustrated embodiment, the gaming controller 12 displays the primary game 88 on the first display 56. In another embodiment, the gaming controller 12 displays the primary game 88 on the first display 56 and/or the second display 58.

In method step 204, the gaming controller 12 randomly generates an outcome 106 of the primary game 88 and displays the generated game outcome 106 in the game screen 54. The gaming controller 12 randomly selects a plurality of game symbols 108 from a predefined set of possible game symbols, and displays the selected game symbols 108 associated with the generated game outcome 106 in the game screen 54. In the illustrated embodiment, the plurality of game symbols 108 are displayed in a display area 110 that includes a grid 112 having a plurality of cells 114 arranged along a plurality of rows 116 and a plurality of columns 118. Each cell 114 displays one or more game symbols 108 associated with the game outcome 106. In the illustrated embodiment, the gaming controller 12 displays the game symbols 108 within a plurality of reels 120. Each reel 120 is associated with a corresponding column 118. In the illustrated embodiment, each cell 114 is displayed with a corresponding cell height 122 that is measured along a vertical axis Y, and a corresponding cell width 124 that is measured along a horizontal axis X. Similarly, each column 118 includes a column height 126 measured along the vertical axis Y, and a column width 128 measured along the horizontal axis X. In the illustrated embodiment, the column width 128 is equal to the cell width 124, and the column height 126 is equal to the sum of the cell height 122 of each cell 114 included in the rows 116. The primary game 88, in the illustrated embodiment, includes 6 reels 120 with 3 cells per reel, respectively (a "6×3" arrangement) displayed in the display area 110. Alternatively, other reel arrangements may be used such as, for example, 3-4-3-4-3, 4-5-5-5-4, or 4-5-4-5-4 arrangements or arrangements with the same number of cells per column, such as 5×3, 3×4, 4×5, or 5×5 configurations. The primary game 88 may also include a plurality of paylines 130 that extend across one or more cells 114 to indicate, to the player, a combination of game symbols 108.

In the illustrated embodiment, the gaming controller 12 receives a signal, from the user input device 16, which is indicative of a player's selection to initiate a gaming session including a wager amount, and a selection of one or more paylines 130 associated with a predefined set of cells 114 within the display area 110. In the illustrated embodiment, the primary game 88 is a multi-line game, i.e., the paylines include horizontal paylines and/or diagonal pay-lines, and/or zig-zag paylines (shown in FIG. 10). Moreover, the user input device 16 may allow the player to toggle to increase the bet per payline a credit at a time (up to the maximum bet). The gaming controller 12 randomly generates an outcome of the primary game 88, and displays the generated outcome on the game screen 54. In one embodiment, the gaming controller 12 is configured to rotate, and/or spin each reel 120 to initiate a game play, and stop each reel 120 to display a plurality of game symbols 108 associated with the randomly generated outcome (shown in FIG. 6). In addition, the gaming controller 12 is adapted to determine if the generated outcome is a winning outcome as a function of the displayed game symbols 108, a paytable, a wager, and one or more player selected paylines 130. More specifically, the gaming controller 12 determines if a combination of symbols 108 arranged along the selected payline 130 is a winning combination. The gaming controller 12 may provide an award in response to the outcome of the primary game 88.

Each primary game 88 is generally played in a conventional manner. The player makes a wager, which may be based on a predetermined denomination and a selected number of paylines 130, the gaming controller 12 randomly generates an outcome for the primary game 88, spins the reels 120, and selectively stops the reels 120 to display a game symbol 108 in each of the display cells 114. If a predetermined pattern of game symbols 108 is randomly chosen for each cell 114 on a played payline 130, the player may be awarded a payout based on the payline, the wager, and a predetermined paytable. Moreover, the player may be awarded a payout if the combination of game symbols 108 associated with a selected payline 130 is a winning combination. In addition, a player may receive a bonus feature, bonus games, and/or free games based on the combination of game symbols 108 associated with the selected payline 130 and/or the appearance of one or more special game symbols in the game outcome 106. Many variations to the above described general play of a slot game fall within the scope of the present invention. Such slot games are well-known in the art, and are therefore not further discussed.

Figure 8:
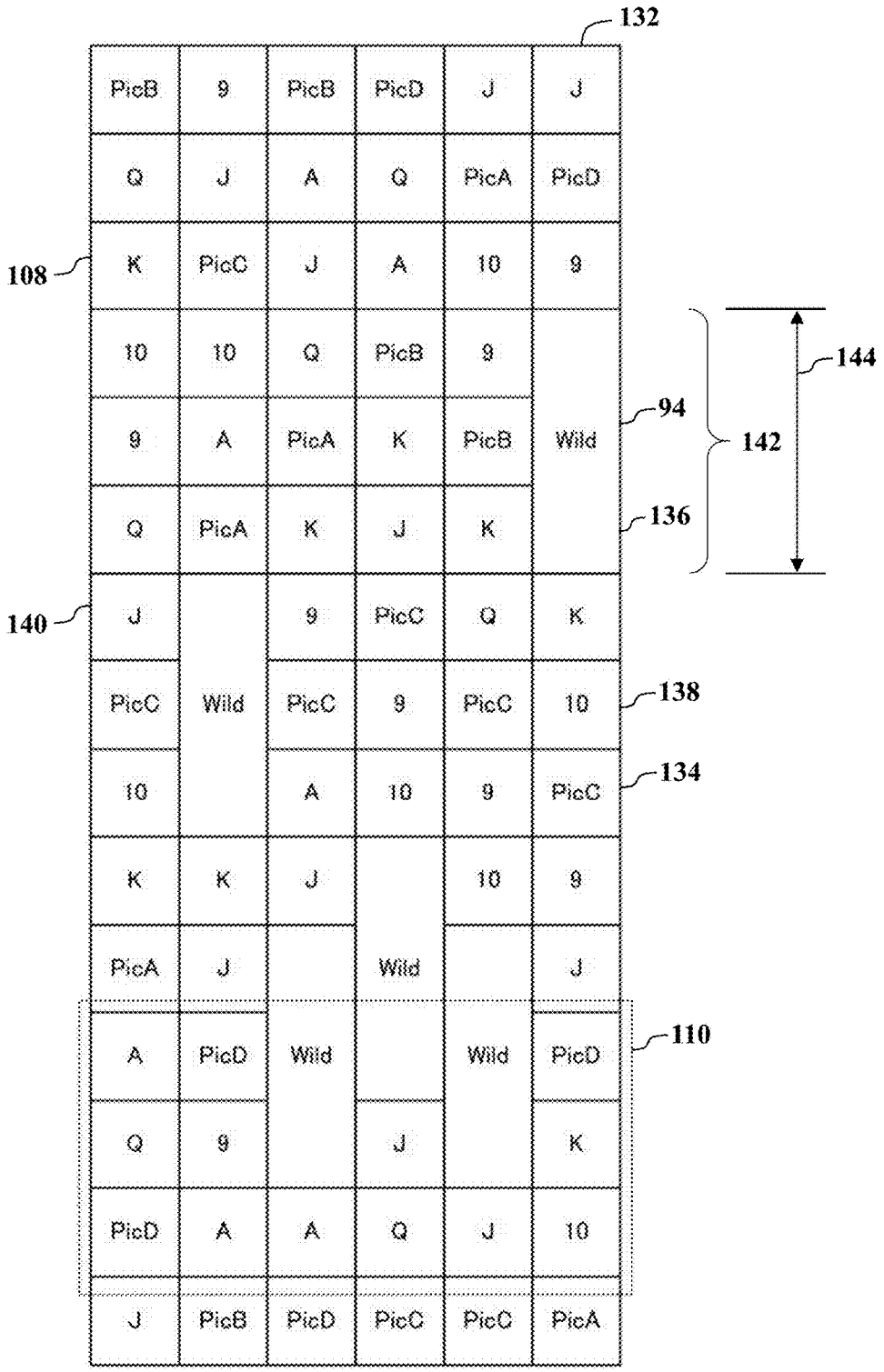
FIG. 8 is schematic representation of reel strips that may be used with the primary slot-type game shown in FIGS. 6 and 7, according to an embodiment of the present invention.
Figure 9:
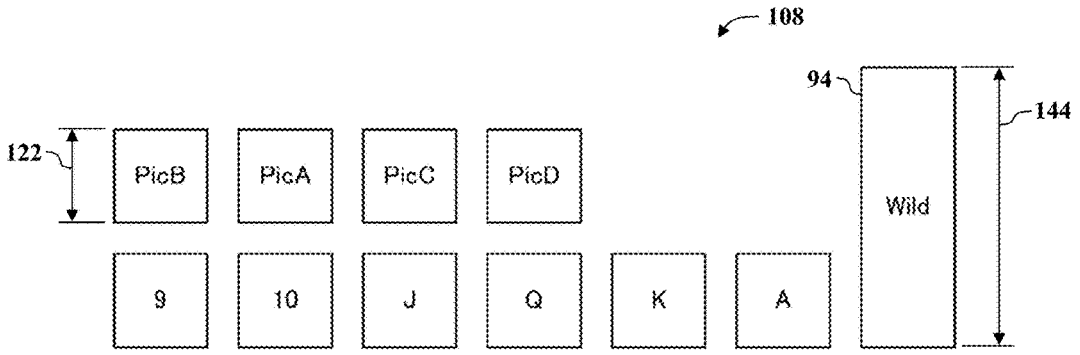
FIG. 9 is an illustration of a set of gaming symbols that may be used with the primary slot-type game shown in FIGS. 6 and 7, according to an embodiment of the present invention.
Figure 10:
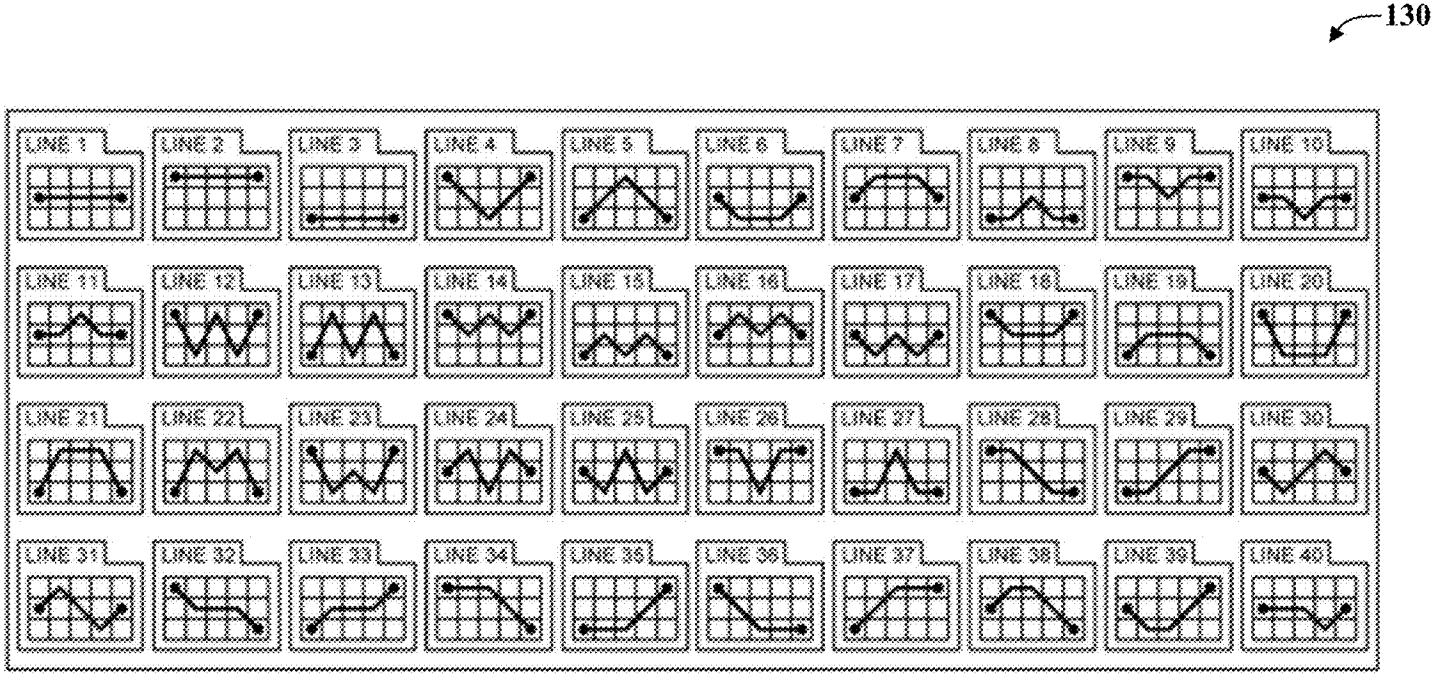
FIG. 10 is an exemplary graphical display of paylines that may be used with the primary slot-type game shown in FIGS. 6 and 7, according to an embodiment of the present invention.

In one embodiment, referring to FIG. 8, the gaming controller 12 may display one or more of the reels 120 with reel strips 132 that includes a plurality of symbol positions 134 that each have a game symbol 108 displayed therein. Each symbol position 134 includes a size and shape that is substantially similar to a grid cell 114. During display of the game, the gaming controller 12 spins each reel 120 such that the game symbols 108 are moved through each of the cells 114 in the display area 110.

In the illustrated embodiment, one or more reel strips 132 includes a plurality of special symbol positions 136 and a plurality of normal symbol positions 138. Each normal symbol position 138 includes a static normal symbol 140 that is not replaced during each instance of the game. Each special symbol position 136 is displayed with one or more trigger symbols 94. In the illustrated embodiment, each trigger symbol 94 is displayed within a run 142 of consecutive adjacent special symbol positions 136. For example, as shown in FIG. 8, the trigger symbol 94 may be displayed within a run of three consecutive special symbol positions 136. In addition, in one embodiment, one or more trigger symbols 94 include a symbol height 144 that is equal to the column height 126. In one embodiment, the symbol height 144 of each trigger symbol 94 may be greater than, or less than, the column height 126.

In one embodiment, a predefined number of reel strips 132 include trigger symbols 94. For example, as shown in FIG. 8, the primary game 88 may be displayed with six reel strips 132 associated with each of the six reels 120. The trigger symbols 94 may be included in the $2^{rd}$, $3^{rd}$, $4^{th}$, and $5^{th}$ reel 120, and not included in the $1^{st}$ reel 120. In another embodiment, trigger symbols 94 may be included in each of the reels 120 being used in the primary game 88.

In addition, in one embodiment, each reel strip 132 may include one or more identical trigger symbols 94. For example, as shown in FIG. 8, each trigger symbol 94 may be wild symbol. The wild symbol may be substituted for one or more game symbols 108 in an outcome of a game. In another embodiment, the trigger symbol 94 may be selected from a predefined set of trigger symbols that include several different trigger symbols. For example, in one embodiment, one or more reel strips 132 may include a run 142 of consecutive special symbol positions 136 including an action stacked symbol that is displayed across each symbol position 134 in the run 142 of consecutive special symbol positions 136. During each play of the primary game 88, the gaming controller 12 may randomly select at least one trigger symbol 94 from the predefined set of trigger symbols, and display the selected trigger symbol 94 across each special symbol position 136 included in the run 142 of consecutive special symbol positions 136. Additional details of action stacked symbols includes runs of consecutive symbol positions, which may be used in the present invention, are described in U.S. patent application Ser. No. 11/299,009 to Yoshimi, now U.S. Pat. No. 8,096,869, filed Dec. 9, 2005, titled "Gaming Machine with Runs of Consecutive Identical Symbols", which is incorporated herein by reference in its entirety.

In method step 206, as shown in FIGS. 7 and 11-14, the gaming controller 12 determines if a triggering condition 92 is detected in the outcome 106 of the primary game 88 and initiates a bonus feature game 90 in response to detecting the triggering condition 92. In the illustrated embodiment, the triggering condition 92 includes the appearance of a plurality of trigger symbols 94 appearing in the outcome of the primary game 88 with the reels 120 stopped. In addition, in one embodiment, the triggering condition 92 also requires each trigger symbols 94 to be displayed across a full column height 126 of the corresponding column 118 (shown in FIG. 7).

In one embodiment, as shown in FIGS. 14*a*-14*d*), the gaming controller 12 is configured to detect the appearance of at least a portion of a trigger symbol 94 being displayed in at least one reel 120 in the outcome of the primary game 88. The gaming controller 12 then modifies the outcome of the primary game 88 by moving, e.g., nudging (shown in FIGS. 14*a*-14*b*), the corresponding reel 120 until the trigger symbol 94 is displayed across a full column height 126. The gaming controller 12 then evaluates the modified outcome 146 of the primary game 88 to detect the occurrence of the triggering condition 92.

In method step 208, upon detecting the appearance of the triggering condition 92, the gaming controller 12 determines a special symbol area 98 (shown in FIG. 7) associated with the triggering condition 92. In the illustrated embodiment, the special symbol area 98 includes each cell 114 associated with the trigger symbols 94 being displayed in the outcome 106 and/or modified outcome 146 of the primary game 88. In one embodiment, as shown in FIG. 7, the outcome 106 of the primary game 88 may include one or more reels being displayed between at least two trigger symbols 94. The gaming controller 12 may determine the special symbol area 98 to include each cell 114 associated with the displayed trigger symbols 94 and each cell 114 associated with the reels 120 being displayed between the trigger symbols 94. In one embodiment, the controller may initiate method 300 and/or method 400 upon detecting the triggering condition 92.

In method step 210, the gaming controller 12 selects a special symbol 96 to be displayed with the special symbol area 98. In one embodiment, the gaming controller 12 may determine a size and shape of the special symbol area 98 and select the special symbol 96 from a set of special symbols 96 as a function of the size and shape of the special symbol area 98. In one embodiment, the gaming controller 12 may access a special symbol table 148 (shown in FIG. 15) and select a special symbol 96 as a function of the size and shape of the special symbol area 98. For example, as shown in FIG. 15, the gaming controller 12 may select a special symbol 96 as a function of the number of cells 114 and/or the cell arrangement included in the special symbol area 98. For example, in one embodiment, each special symbol may display a different symbol image, or various sizes and shapes of similar images.

In addition, as shown in FIGS. 13 and 14, the special symbol 96 may be similar to each trigger symbol 94. In one embodiment, each special symbol 96 included in the set of special symbols 96 may be associated with a different symbol value such as, for example, a different award multiplier value. In addition, each special symbol 96 may have an associated selection probability associated with the cell arrangement and/or the number of cells 114 included in the special symbol area 98. For example, in one embodiment, the gaming controller 12 may access a special symbol selection table 150 (shown in FIG. 16) to determine a selection probability of each special symbol 96 as a function of the cell arrangement and/or the number of cells 114 included in the special symbol area 98, and randomly select the special symbol 96 as a function of the determine probabilities. In one embodiment, the special symbol 96 may be a wild symbol that substitutes for one or more game symbols 108 to facilitate increasing a probability of providing a higher value award to the player.

In method step 212, the gaming controller 12 replaces each symbol 108 displayed with the special symbol area 98 with the special symbol 96 such that the special symbol 96 extends across each cell 114 included in the special symbol area 98. In one embodiment, as shown in FIGS. 11*d*, 12*d*, 12*h*, 13*b*, and 14*c*, the gaming controller 12 may display a transition image 100 within the special symbol area 98 before displaying the special symbol 96.

In method step 214, the gaming controller 12 determines a number of instances and/or free spins associated with the bonus feature game 90, randomly generates and displays an instance of the bonus feature game 90, and provides an award to the player as a function of the outcome of the instance of the bonus feature game 90. For example, the gaming controller 12 may select a number of spins of the bonus feature game 90 with probability corresponding to a bet amount per payline, a number of selected payline and/or a total amount of wager. In another example, the game controller 12 provides at least one or more, predetermined number of spins of the bonus feature game. In the illustrated embodiment, as shown in FIGS. 12*e* and 13*d*, for each instance of the bonus feature game 90, the gaming controller 12 retains the special symbol 96 in position, and spins and stops the other reels 120 to display the corresponding outcome of the instance of the bonus feature game 90.

In method step 216, the gaming controller 12 determines if a retriggering condition 102 is detected in the outcome of an instance of the bonus feature game 90 including another trigger symbol 94 being displayed in the corresponding outcome. In one embodiment, the retriggering condition 102 includes the trigger symbol 94 being displayed across a full column height 126. In another embodiment, the gaming controller 12 may detect the appearance of a portion of the trigger symbol 94 and move and/or nudge the corresponding reel 120 until the trigger symbol 94 is displayed across a full column height 126.

In method step 218, the gaming controller 12 determines a second special symbol area 152 that includes the cells 114 being displayed with the special symbol 96, the cells 114 being displayed with the trigger symbol 94, and the cells 114 being displayed with any intervening reel 120 displayed between the special symbol 96 and the trigger symbol 94. The gaming controller 12 selects a second special symbol 104 as a function of the second special symbol area 152 as replaces each the special symbol 96, the trigger symbol 94, and each symbol 108 being displayed in the cells 114 between the special symbol 96 and the trigger symbol 94 with the second special symbol 104 such that the second special symbol 104 is displayed across each cell 114 included in the second special symbol area 152. In one embodiment, the gaming controller 12 may display another transition image 100 within the second special symbol area 152 before displaying the second special symbol 104. The second special symbol 104 may also be selected from the special symbol table 148 and/or the special symbol selection table 150. In one embodiment, the second special symbol 104 may be a wild symbol that substitutes for one or more game symbols 108 to facilitate increasing a probability of providing a higher value award to the player.

In method step 218, the gaming controller 12 randomly generates and displays another instance of the bonus feature game 90 including the second special symbol 104 being retaining in the second special display area 110 and spinning and stopping the remaining reels 120 to display the corresponding outcome. The gaming controller 12 evaluates the corresponding outcome including the retained second special symbol 104 and provides an award to the player as a function of the corresponding outcome.

Referring to FIG. 11, in one embodiment, the gaming controller 12 initiates the primary game 88 and spins and stops the reels 120 to display the outcome of the primary game 88.

Figure 11A:
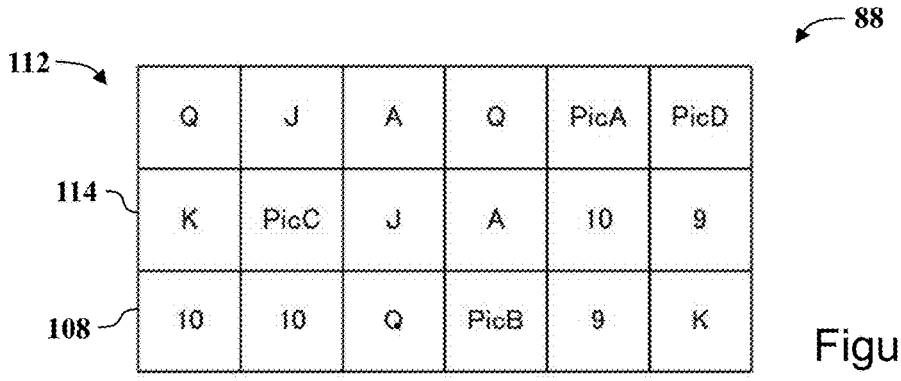
FIGS. 11*a*-11*e* are exemplary entertaining graphical displays of a bonus feature game that may be displayed on the gaming device shown in FIG. 1, according to an embodiment of the present invention.
Figure 11B:
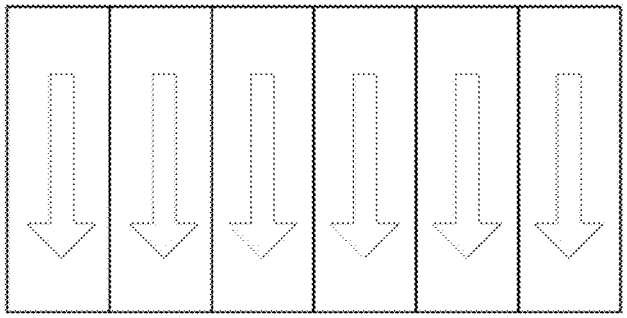
Figure 11C:
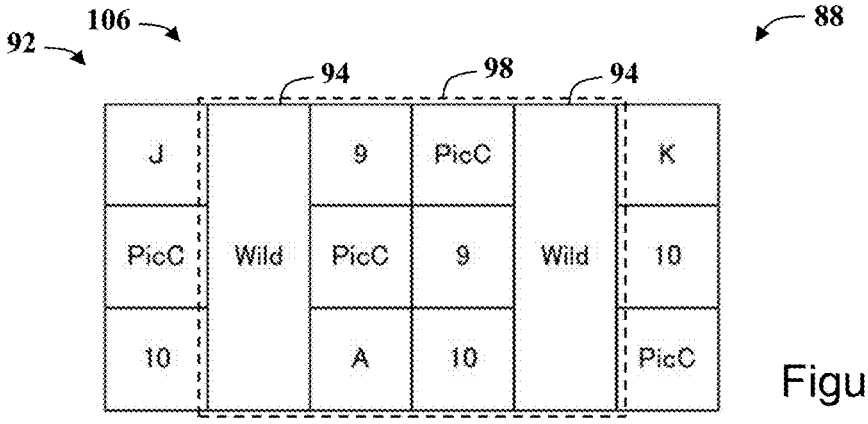
Figure 11D:
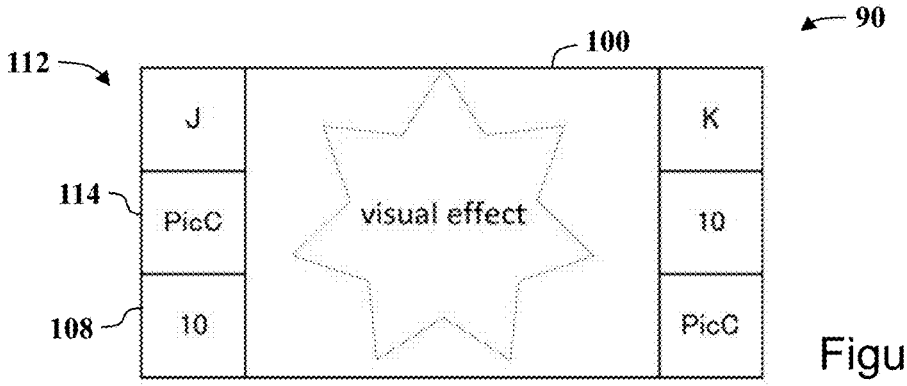
Figure 11E:
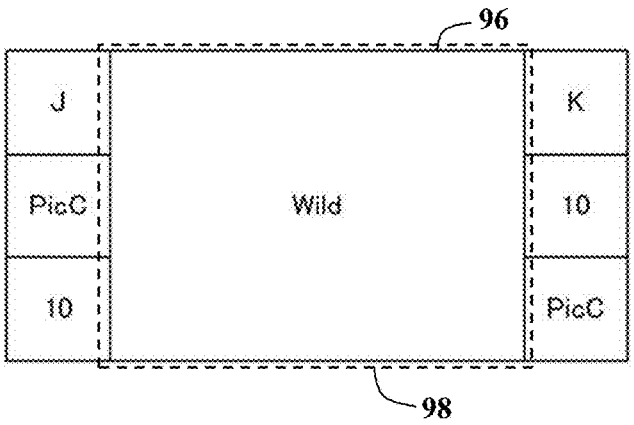

For example, as shown in FIG. 11*c*, when Reel f-6 stop spinning, full reel wilds may appear on reel 2 and 4. The gaming controller 12 determines an award that is paid for the winning combination. Moreover, two full reel wilds trigger the bonus feature game 90. As shown in FIG. 11*d*, the reels with full reel wild and the reels sandwiched by them are covered with visual effect. Fading out the visual effect, four reels are occupied by the special symbol 96 including a 4×3 size big wild. The big wild is held and reels 1 and 6 start re-spinning.

In one embodiment, as shown in FIG. 12*f*, the reel 1 and 6 stop re-spinning and an award is paid to winning combination. In this case, the result does not satisfy retrigger condition. The game is ended.

In another embodiment, as shown in FIG. 12*g*, the reels 1 and 6 stop re-spinning and an award is paid to winning combination. In this case, additional full reel wild on reel 6 satisfies retrigger condition and the bonus feature game is retriggered. The reels with large size wild and the reels with full reel wild are covered with visual effect (shown in FIG. 12*h*). Fading out the visual effect, five reels are occupied by a second special symbol 104 including a 5×3 size big wild. The big wild is held and reel 1 starts re-spinning. The reel 1 stops re-spinning. Award is paid to winning combination and the game is ended.

Exemplary embodiments of a gaming device, a gaming system, and a method of providing an award to a player are described above in detail. The gaming device, system, and method are not limited to the specific embodiments described herein, but rather, components of the gaming device and/or system and/or steps of the method may be utilized independently and separately from other components and/or steps described herein. For example, the gaming device may also be used in combination with other gaming systems and methods, and is not limited to practice with only the gaming device as described herein. Rather, an exemplary embodiment can be implemented and utilized in connection with many other gaming system applications.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. That is, the database may include any structure of accessible collected data in this specification. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A gaming machine for providing a game to a player, comprising:

a display device configured to display computer-generated graphics; and a gaming controller coupled to the display device, the gaming controller including a processor for generating the game on the display device, the processor programmed to:

display a primary game on the display device, the primary game including a plurality of reels being displayed in a grid including a plurality of cells being arranged in rows and columns, each reel being displayed within one of the columns and including a plurality of symbols;

randomly generate an outcome of the primary game and spin and stop the reels to display the outcome of the primary game;

detect a triggering condition appearing in the outcome of the primary game including the appearance of a plurality of trigger symbols, each of the trigger symbols being displayed in a corresponding column, wherein the triggering condition includes trigger symbols being displayed across a full height of first and second columns;

initiate a bonus feature game in response to detecting the triggering condition and generating an outcome of the bonus feature game including:

identifying a special symbol area including each cell of the first and second columns and the cells of any column between the first and second columns; and replacing the trigger symbols with a special symbol being displayed within the special symbol area; and provide an award to the player as a function of the outcome of the bonus feature game.

2. A gaming machine in accordance with claim 1, the gaming controller configured to:

determine if at least one reel displays a portion of a corresponding trigger symbol in the outcome of the primary game and responsively modifying the outcome of the primary game including moving the at least one reel to display the corresponding trigger symbol across the full height of the corresponding column; and determine if the triggering condition is detected in the modified outcome of the primary game.

3. A gaming machine in accordance with claim 1, wherein the outcome of the primary game includes at least one reel being displayed between at least two triggering symbols.

4. A gaming machine in accordance with claim 1, the gaming controller configured to display the outcome of the bonus feature game including spinning and stopping the reels with the special symbol being held in position.

5. A gaming machine in accordance with claim 4, the gaming controller configured to:

detect a retriggering condition appearing the outcome of the bonus feature game, the retriggering condition including another trigger symbol being displayed in a corresponding column in the outcome of the bonus feature game and extending across a full height of the corresponding column; and replace the special symbol and the another trigger symbol with a second special symbol extending across the area associated with the special symbol and each cell associated with the another trigger symbol.

6. A gaming machine in accordance with claim 1, the special symbol being a wild symbol to facilitate increasing a probability of providing a higher value award to the player.

7. A gaming machine in accordance with claim 1, the gaming controller configured to display a transition image within the special symbol area before displaying the special symbol.

8. A gaming machine in accordance with claim 1, the gaming controller configured to select the special symbol from a set of special symbols as a function of a number of cells included in the special symbol area.

9. A computer-implemented method of providing a game to a player via a gaming machine including a display device and a gaming controller, the display device configured to display computer-generated graphics, the gaming controller coupled to the display device, the gaming controller including a processor for generating the game on the display device, the processor programmed to perform the steps of:

displaying a primary game on the display device, the primary game including a plurality of reels being displayed in a grid including a plurality of cells being arranged in rows and columns, each reel being displayed within one of the columns and including a plurality of symbols;

randomly generating an outcome of the primary game and spin and stop the reels to display the outcome of the primary game;

detecting a triggering condition appearing in the outcome of the primary game including the appearance of a plurality of trigger symbols, each of the trigger symbols being displayed in a corresponding column, wherein the triggering condition includes trigger symbols being displayed across a full height of first and second columns;

initiating a bonus feature game in response to detecting the triggering condition and generating an outcome of the bonus feature game including:

identifying a special symbol area including each cell of the first and second columns and the cells of any column between the first and second columns; and replacing the trigger symbols with a special symbol being displayed within the special symbol area; and providing an award to the player as a function of the outcome of the bonus feature game.

10. A computer-implemented method in accordance with claim 9, wherein the triggering condition includes each of the trigger symbols being displayed across a full height of the corresponding column.

11. A computer-implemented method in accordance with claim 10, including the steps of:

determining if at least one reel displays a portion of a corresponding trigger symbol in the outcome of the primary game and responsively modifying the outcome of the primary game including moving the at least one reel to display the corresponding trigger symbol across the full height of the corresponding column; and determining if the triggering condition is detected in the modified outcome of the primary game.

12. A computer-implemented method in accordance with claim 9, wherein the outcome of the primary game includes at least one reel being displayed between at least two triggering symbols, the method including the steps of initiating the bonus feature game including replacing each of the at least two triggering symbols and each symbol being displayed with the at least one reel with the special symbol.

13. A computer-implemented method in accordance with claim 9, including the steps of displaying the outcome of the bonus feature game including spinning and stopping the reels with the special symbol being held in position.

14. A computer-implemented method in accordance with claim 13, including the steps of:

detecting a retriggering condition appearing the outcome of the bonus feature game, the retriggering condition including another trigger symbol being displayed in a corresponding column in the outcome of the bonus feature game and extending across a full height of the corresponding column; and replacing the special symbol and the another trigger symbol with a second special symbol extending across the area associated with the special symbol and each cell associated with the another trigger symbol.

15. A computer-implemented method in accordance with claim 9, the special symbol being a wild symbol to facilitate increasing a probability of providing a higher value award to the player.

16. A computer-implemented method in accordance with claim 9, including the steps of displaying a transition image within the special symbol area before displaying the special symbol.

17. A computer-implemented method in accordance with claim 9, including the steps of selecting the special symbol from a set of special symbols as a function of a number of cells included in the special symbol area.

18. One or more non-transitory computer-readable storage media, having computer-executable instructions embodied thereon, wherein when executed by at least one processor, the computer-executable instructions cause the processor to:

display a primary game on a display device, the display device configured to display computer-generated graphics, the primary game including a plurality of reels being displayed in a grid including a plurality of cells being arranged in rows and columns, each reel being displayed within one of the columns and including a plurality of symbols;

randomly generate an outcome of the primary game and spin and stop the reels to display the outcome of the primary game;

detect a triggering condition appearing in the outcome of the primary game including the appearance of a plurality of trigger symbols, each of the trigger symbols being displayed in a corresponding column, wherein the triggering condition includes trigger symbols being displayed across a full height of first and second columns;

initiate a bonus feature game in response to detecting the triggering condition and generating an outcome of the bonus feature game including:

identifying a special symbol area including each cell of the first and second columns and the cells of any column between the first and second columns; and replacing the trigger symbols with a special symbol being displayed within the special symbol area; and provide an award to the player as a function of the outcome of the bonus feature game.

19. The one or more non-transitory computer-readable storage media in accordance with claim 18, wherein the triggering condition includes each of the trigger symbols being displayed across a full height of the corresponding column.

* * * * *